US011523664B2

(12) United States Patent
Fisher

(10) Patent No.: US 11,523,664 B2
(45) Date of Patent: Dec. 13, 2022

(54) CANTILEVER UMBRELLA AND DEVICES THEREFOR

(71) Applicant: Unicrest Group Limited, Whangarei (NZ)

(72) Inventor: James Fisher, Dunedin (NZ)

(73) Assignee: Unicrest Group Limited, Whangarei (NZ)

( * ) Notice: Subject to any disclaimer, the term of this patent is extended or adjusted under 35 U.S.C. 154(b) by 64 days.

(21) Appl. No.: 17/252,609

(22) PCT Filed: Jun. 18, 2019

(86) PCT No.: PCT/NZ2019/050070
§ 371 (c)(1),
(2) Date: Dec. 15, 2020

(87) PCT Pub. No.: WO2019/245389
PCT Pub. Date: Dec. 26, 2019

(65) Prior Publication Data

US 2021/0251352 A1 Aug. 19, 2021

(30) Foreign Application Priority Data

Jun. 18, 2018 (NZ) ..... 743559

(51) Int. Cl.
*A45B 23/00* (2006.01)
*A45B 25/14* (2006.01)

(52) U.S. Cl.
CPC ..... *A45B 23/00* (2013.01); *A45B 25/14* (2013.01); *A45B 2023/0012* (2013.01); *A45B 2023/0056* (2013.01); *A45B 2023/0068* (2013.01); *A45B 2023/0081* (2013.01)

(58) Field of Classification Search
CPC .... A45B 2023/0031; A45B 2023/0056; A45B 2023/0068; A45B 2023/0037; A45B 2023/005; A45B 2023/0075
See application file for complete search history.

(56) References Cited

U.S. PATENT DOCUMENTS

| | | | | |
|---|---|---|---|---|
| 4,433,699 | A * | 2/1984 | Schultes | A45B 23/00 135/117 |
| 8,807,513 | B2 * | 8/2014 | Volin | A45B 17/00 248/521 |
| 9,220,325 | B2 * | 12/2015 | Ma | A45B 23/00 |
| 10,136,709 | B2 * | 11/2018 | Ma | A45B 23/00 |
| 2002/0129847 | A1 * | 9/2002 | Ma | A45B 23/00 135/21 |
| 2010/0212705 | A1 * | 8/2010 | Tung | A45B 23/00 135/20.1 |
| 2020/0397103 | A1 * | 12/2020 | Glatz | A45B 25/14 |

* cited by examiner

*Primary Examiner* — Noah Chandler Hawk

(57) ABSTRACT

A cantilever umbrella has an upstanding mast and a cantilever arm adapted to support a canopy. The mast has an interior region defined by a longitudinally extending channel with a longitudinally aligned opening extending from the interior to the exterior of the mast. A carriage resides within the channel and is adapted for travel within the channel. Raising the carriage within the channel causes the cantilever to transition to the open position, and lowering of the carriage causes the cantilever to transition to the closed position.

14 Claims, 13 Drawing Sheets

CANTILEVER UMBRELLA AND DEVICES THEREFOR

CROSS REFERENCE TO RELATED APPLICATIONS

This application is the U.S. National Stage of International Application No. PCT/NZ2019/050070, filed Jun. 18, 2019, which claims priority to New Zealand application no. 743559, filed on Jun. 18, 2018, both of which are incorporated herein by reference.

FIELD OF THE INVENTION

The invention relates to umbrellas and more particularly, to an umbrella having a foldable canopy which is suspended in cantilever fashion from a support post and mechanisms therefor.

BACKGROUND TO THE INVENTION

Umbrellas are devices which are typically utilised in an outdoor setting, such as in an outdoor patio, balcony, garden, cafe, and the like to provide shade and protection against the elements. Umbrellas generally include a canopy mounted over a plurality of support ribs. The support ribs can be collapsed into a storage position for the canopy assembly and can be deployed and supported in position to hold up and extend the fabric and thereby provides protection from the elements. The canopy is generally supported from beneath or from above. Umbrellas supported from above as typically known as cantilever umbrellas and have the advantage of providing space below the canopy where people can sit without the obstruction of a pole extending from below the canopy to the ground.

However, cantilever umbrellas known in the prior art typically require complex mechanisms to facilitate the deployment, collapse and storage of the canopy. Such mechanisms are typically prone to gathering environmental debris and, over time, becoming seized, damaged and/or unsightly. Further, cantilever umbrellas typically require a certain amount of physical strength from the user to lift and deploy.

It is an object of the present invention to go some way toward overcoming or at least ameliorating the abovementioned difficulty or at least provide the public with a useful choice. Other objects of the invention may become apparent from the following description which is given by way of example only.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

SUMMARY OF THE INVENTION

In a first aspect the invention broadly consists in an umbrella comprising an upstanding mast and a cantilever arm adapted to support a canopy, the cantilever arm pivotally attached to the mast at an upper portion and configured to pivot between an open position where the canopy is deployed and where the cantilever arm extends away from the mast, and a closed position where the canopy is withdrawn and the cantilever arm extends close to the mast;

the mast comprising an interior region; wherein the interior region comprises a longitudinally extending channel; the channel comprising an aperture extending from the interior to the exterior of the mast;

a carriage configured to travel longitudinally within the channel; and a support arm pivotally connected to the cantilever arm at one end, and at an opposing end pivotally connect with the carriage;

wherein raising of the carriage within the channel causes the cantilever to transition to the open position, and lowering of the carriage causes the cantilever to transition to the closed position.

In some embodiments, the interior channel of the mast comprises an outer facing interior surface, and an inner facing interior surface; and the carriage comprises wheel surface adapted to engage with the outer facing interior surface and wheel surface adapted to engage with the inner facing interior surface.

In some embodiments, the outer facing interior surface comprises a longitudinally extending ridge, and the first set of wheel surfaces comprises an axial ridge complementary to the ridge of the outer facing interior surface such that, in use, engagement of each lip provides at least some longitudinal alignment of the carriage within the channel.

In some embodiments, the carriage comprises a chassis adapted to support at least one axle; the at least one axle configured to rotationally support the first set of wheel surfaces.

In some embodiments, the chassis comprises at least one opening through which the second set of wheel surfaces extends to thereby engage with the inner facing interior surface.

In some embodiments, at least the first set of wheels and/or the second set of wheel surfaces are located at an upper end of the carriage and/or the lower end of the carriage, and/or proximate the middle of the carriage.

In some embodiments, the carriage further comprises a mount, the mount adapted for the pivotal connection with the support arm; and wherein the mount, pivotal connection or support arm extend from the carriage within the mast interior, through the channel aperture, to the exterior of the mast.

In some embodiments, the carriage further comprises an engagement mechanism configured to lock the carriage to the mast, the engagement mechanism comprising:

a locking component operable to transition between an engaged position and an disengaged position; and a biasing component operable to bias the locking component toward the locked position.

In some embodiments, the engagement mechanism further comprising a trigger component connected to the locking component and operable to transition from the engaged position to the disengaged position.

In some embodiments, the mast further comprises a receptacle and the engaged position is configured for engagement with the receptacle.

In some embodiments, the receptacle is biased to retain the locking component under vertical load.

In some embodiments, the engagement component further comprises a trigger component operably connected to the locking component and configured to at least cause transition of the locking component from the engaged to the disengaged position.

In some embodiments, the mast further comprises a receptacle adapted for engagement with the locking component, such that, raising the carriage within the channel causes engagement of the locking component with the receptacle.

In some embodiments, the receptacle is contained by a device removeably attached to the mast.

In another broad aspect the invention consists in an umbrella comprising an upstanding mast and a cantilever arm adapted to support a canopy, the cantilever arm pivotally attached to the mast at an upper portion and configured to pivot between an open position where the canopy is deployed and where the cantilever arm extends away from the mast, and a closed position where the canopy is withdrawn and the cantilever arm extends close to the mast;

a carriage configured to travel on the mast between a raised and lowered position, the carriage pivotally connected to the cantilever arm by a support arm such that raising the carriage on the mast to the raised position causes the cantilever to transition to the open position, and lowering of the carriage to the lowered position causes the cantilever to transition to the closed position; and wherein the mast comprises at least one receptacle and the carriage comprises an engagement mechanism configured to selectively lock the carriage to the at least one receptacle, the engagement mechanism comprising:

a locking component configured to transition between an engaged position, when aligned with the receptacle, and an disengaged position, and a biasing component operable to bias the locking component into the engaged position when aligned with the at least one receptacle.

In some embodiments, the mast further comprises a longitudinally extending channel, the channel comprising an aperture extending from the interior to the exterior of the mast; and the carriage configured to travel longitudinally within the channel.

In some embodiments, the interior channel of the mast comprises an outer facing interior surface, and an inner facing interior surface; and the carriage comprises wheel surface adapted to engage with the outer facing interior surface and wheel surface adapted to engage with the inner facing interior surface.

In some embodiments, the receptacle is biased to retain the locking component under vertical load.

In some embodiments, the engagement component further comprises a trigger component operably connected to the locking component and configured to at least cause transition of the locking component from the engaged to the disengaged position.

In another broad aspect, the invention consists in an umbrella comprising an upstanding mast and a cantilever arm adapted to support a canopy, the cantilever arm pivotally attached to the mast at an upper portion and configured to pivot between an open position where the canopy is deployed and where the cantilever arm extends away from the mast, and a closed position where the canopy is withdrawn and the cantilever arm extends close to the mast;

a carriage configured to travel on the mast between a raised and lowered position, the carriage pivotally connected to the cantilever arm by a support arm such that raising the carriage on the mast to the raised position causes the cantilever to transition to the open position, and lowering of the carriage to the lowered position causes the cantilever to transition to the closed position;

wherein the mast comprises at least one receptacle and the carriage comprises an engagement mechanism configured to selectively lock the carriage to the at least one receptacle, the engagement mechanism comprising:

a locking component configured to transition between an engaged position, when substantially aligned with the receptacle, and an disengaged position.

In some embodiments, the engagement mechanism further comprises a handle connected to a follower and the locking component comprises a rocker with at least a first lobe arranged to pivot, relative to the carriage, between the engaged position and the disengaged position; and wherein the rocker has a camming surface actuated by the follower so as to cause the at least a first lobe to pivot between the engaged position and the disengaged position.

In some embodiments, the rocker further comprises a second lobe arranged to pivot opposed to the first lobe.

In some embodiments, the mast comprises a second receptacle, and the second lobe is configured to engage with the second receptacle when the first lobe is in the disengaged position.

In some embodiments, the mast further comprises a longitudinally extending channel, the channel comprising an aperture extending from the interior to the exterior of the mast; and the carriage configured to travel longitudinally within the channel.

In some embodiments, the interior channel of the mast comprises an outer facing interior surface, and an inner facing interior surface; and the carriage comprises wheel surface adapted to engage with the outer facing interior surface and wheel surface adapted to engage with the inner facing interior surface.

In some embodiments, the receptacle is biased to retain the locking component under vertical load.

In some embodiments, the engagement component further comprises a trigger component operably connected to the locking component and configured to at least cause transition of the locking component from the engaged to the disengaged position.

In another broad aspect, the invention consists in a assembly adapted to support an upstanding mast, the mast comprising an interior region and wherein the interior region comprises a first longitudinally extending channel and a second longitudinally extending channel, the first longitudinally extending channel comprising an aperture extending from the interior to the exterior of the mast; the assembly comprising:

a base assembly comprising a base plate and a vertical support member extending from the base plate; the base plate having a plurality of apertures located about the vertical support member, and the vertical support of a form adapted to rotatably receive the second longitudinally extending channel of the mast; and a locking assembly comprising a housing, a latching mechanism, and a pin; the pin supported within the housing and adapted for displacement by the latching mechanism between at least an disengaged position and a engaged position, and orientated within the housing for axial alignment with the plurality of apertures of the base plate; and wherein the housing is of a form adapted to be received the first longitudinally extending channel of the mast, and the latching mechanism is configured to extend through the aperture of the second longitudinally extending channel to thereby allow the pin to be moved at least from the engaged to the disengaged position.

In some embodiments, the locking assembly further comprises one or more fasteners adapted to fix the housing into the first longitudinally extending channel of the mast.

In some embodiments, the vertical support member comprises a circumferential groove in the outer surface thereof at a location vertically displaced from the base plate; and the locking mechanism further comprises a spigot adapted to extend from the housing and into the circumferential groove to thereby prevent vertical movement of the mast relative to the vertical support member, yet allow rotation of the mast relative to the vertical support member.

In some embodiments, the latching mechanism comprises a pivot and a lever extending from the pivot; and the lever is pivotably attached to the pin such that raising the lever raises the pin, and lowering the levers lower the pin; and whereby the pin, when lowered, engages with the apertures of the base plate to thereby prevent rotation of the mast relative to the base plate.

In some embodiments, the latching mechanism further comprises a catch operable to retain the lever in a lowered position whereby the lever is housed substantially within the second channel of the mast.

In another broad aspect, the invention consists in a hub body adapted to provide support for a plurality of radiating ribs of an umbrella, the hub body comprising a plurality of channels adapted to receive a pin orientated perpendicular to the orientation of and for the support of a radiating rib;

wherein at least some channels comprise an amalgamation of at least a first slot form and second slot form, wherein the first slot form is orientated perpendicular to a 45 degree separation angle of rib radiation, and the second slot form is orientated perpendicular to another separation angle of rib radiation.

In some embodiments, the hub body comprises an upper body component and a lower body component adapted to come together in a clamshell formation, wherein at least one of upper or lower the body components is adapted to close the channels.

In some embodiments, the hub body includes one or more of a light, speaker, heater, energy storage and/or charging circuits.

In another broad aspect, the invention consists in an umbrella comprising a hub body adapted to provide support for a plurality of radiating ribs of an umbrella, the hub body comprising a plurality of channels adapted to receive a pin orientated perpendicular to the orientation of and for the support of a radiating rib;

wherein at least some channels comprise an amalgamation of at least a first slot form and second slot form, wherein the first slot form is orientated perpendicular to a 45 degree separation angle of rib radiation, and the second slot form is orientated perpendicular to another separation angle of rib radiation.

In another broad aspect, the invention consists in an umbrella comprising:

an upstanding mast comprising an interior region and wherein the interior region comprises a longitudinally extending channel with an aperture extending from the interior to the exterior of the mast;

a canopy configured to drape substantially alongside the mast in at least a retracted form; and a retractable strap contained within the interior region, the strap adapted to pass through the aperture and envelope the canopy in the retracted form to thereby secure the canopy.

In some embodiments, the retractable strap is mounted in a housing, and the housing is adapted to locate within the interior region of the mast.

In some embodiments, the housing comprises a spindle upon which the strap is releaseably wound; and a clock spring adapted to bias the spindle into a strap-wound position.

In some embodiments, the invention relates to any one or more of the above statements in combination with any one or more of any of the other statements. Other aspects of the invention may become apparent from the following description which is given by way of example only and with reference to the accompanying drawings.

The entire disclosures of all applications, patents and publications, cited above and below, if any, are hereby incorporated by reference. This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

The invention can be better understood with reference to the following drawings. The elements of the drawings are not necessarily to scale relative to each other, emphasis instead being placed upon clearly illustrating the principles of the invention. Furthermore, like reference numerals designate corresponding parts throughout the several views.

FIG. 24 shows a side section view of the umbrella mounting assembly in an unlocked configuration;

DETAILED DESCRIPTION OF THE INVENTION

Exemplary methods and systems are described herein. It should be understood that the word "exemplary" is used herein to mean "serving as an example, instance, or illustration." Any embodiment or feature described herein as "exemplary" or "illustrative" is not necessarily to be construed as preferred or advantageous over other embodiments or features. More generally, the embodiments described herein are not meant to be limiting. It will be readily understood that certain aspects of the disclosed systems and methods can be arranged and combined in a wide variety of different configurations, all of which are contemplated herein.

The term "and/or" referred to in the specification and claim means "and" or "or", or both. The term "comprising" as used in this specification and claims means "consisting at least in part of". When interpreting statements in this specification and claims which include that term, the features, prefaced by that term in each statement all need to be present but other features can also be present. Related terms such as "comprise" and "comprised" are to be interpreted in the same manner.

As used herein, the singular forms "a," "an," and "the" are intended to include the plural forms as well, unless expressly stated otherwise.

It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "connected" or "coupled" to another element, it can be directly connected or coupled to the other element or intervening elements may be present.

As used herein, the term "and/or" includes any and all combinations of one or more of the associated listed items.

Figure 1:
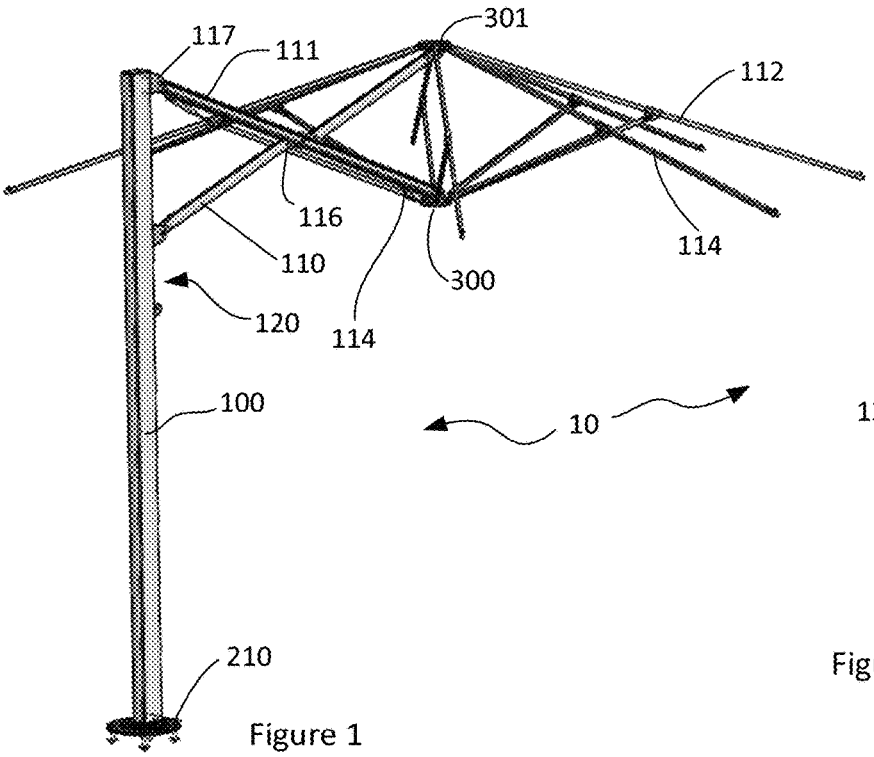
FIG. 1 shows a rear perspective view of a cantilever umbrella 10 in an opened configuration.
Figure 2:
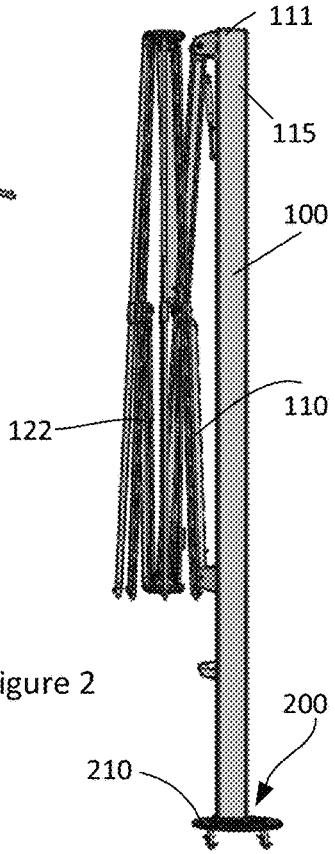
FIG. 2 shows a side view of the cantilever umbrella in a closed configuration.
Figure 3:
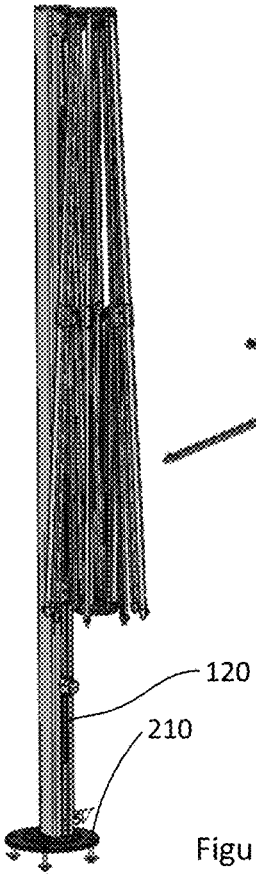
FIG. 3 shows a front perspective view of the cantilever umbrella in a closed configuration.
Figure 4:
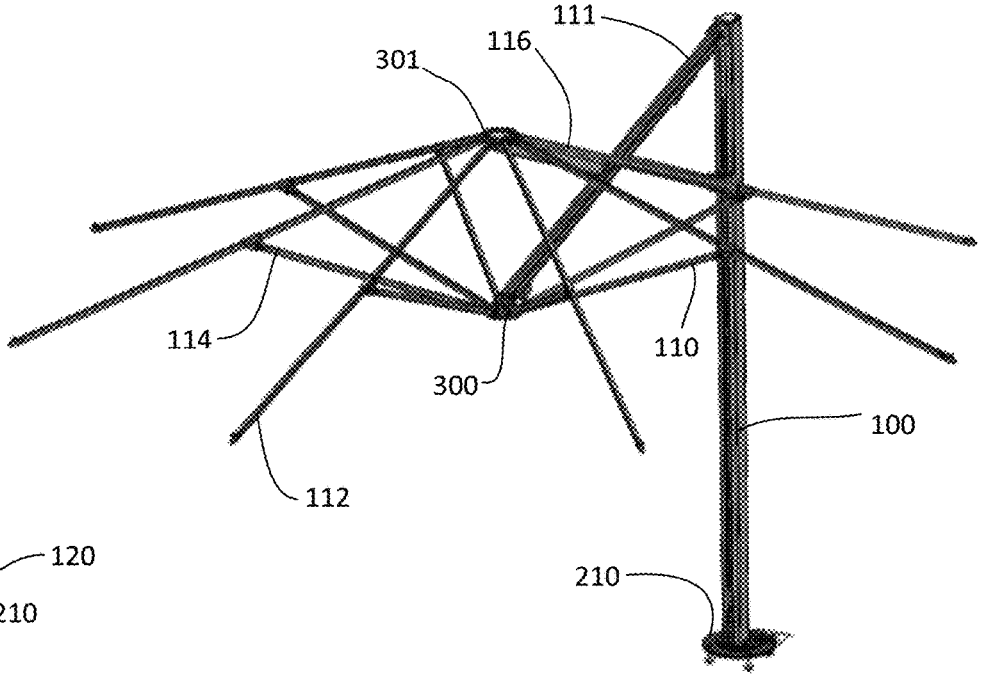
FIG. 4 shows a front perspective view of the cantilever umbrella in an open configuration.

Referring now to the drawings, in which like numerals indicate like elements throughout the several views, FIGS. 1-4 generally illustrate the form of a cantilever umbrella 10 which provides a functional and aesthetically pleasing design but internalising many mechanisms within the mast. However, internalising functional components leads to the potential issues of how required components are interfaced by users and how they are to operate. In the embodiments discussed herein, these issues are addressed. In particular, FIG. 1 shows a rear perspective view of a cantilever umbrella 10 in an opened configuration; FIG. 2 shows a side view of the cantilever umbrella 10 in a closed configuration; FIG. 3 shows a front perspective view of the cantilever umbrella 10 in a closed configuration; and FIG. 4 shows a front perspective view of the cantilever umbrella 10 in an open configuration.

The cantilever umbrella 10 generally comprises an upstanding mast 100 pivotally connected to each of an upper cantilever arm 110 and lower cantilever arm 111 which are adapted to support a plurality of upper ribs 112 which in turn support a canopy (not shown). In the exemplary embodiment depicted, the upper cantilever arm 111 is attached to an upper portion of the mast at a pivot point 117, and the lower cantilever arm 110 is pivotally connected between the upper cantilever arm 111 and the mast. Each arm 110, 111 is configured to move between an open position where the canopy is deployed (FIGS. 1 and 4) where the cantilever arms extend away from the mast, and a closed position where the canopy is retracted (FIGS. 2 and 3) and the cantilever arms are lowered down close to and parallel with the mast.

A lower hub 300 and upper hub 301 act as support for the pivotal attachment of a plurality of upper ribs 112 which support a canopy and the lower ribs 114 which act to raise and lower the upper ribs.

The pair of cantilever arms extend between the mast at one end and to or toward the lower hub 300 at an opposing end to act to move the hubs 300, 301 away from the mast during a retracted to deployed movement. The cantilever arms act in a scissor type relationship where the relative displacement along the mast where each arm is attached is bought together to cause the retracted to deployed movement.

To facilitate such a movement, the upper cantilever arm 111 is attached at an upper portion of the mast at a first end by a pivotal link 117, and pivotally attached to the lower hub 300 at or toward an opposing end. The lower cantilever arm 110 is operatively associated with the mast at a mast-proximate end, and has a pivotal connection 116 at an opposing end to the upper cantilever arm 111. In this way, vertical movement of the lower cantilever arm 110 about the mast causes movement of the upper cantilever arm.

In particular, raising the vertical position of the lower cantilever arm 110 relative to the mast 100 causes the upper cantilever arm 111 to be raised, and the hubs 300, 301 and ribs, 112, 114 to also be raised such that a canopy supported by the upper ribs is deployed.

The lower cantilever arm 110 may attach to the upper cantilever arm 111 at any point along the arm according to the mechanical ratio desired. For example, attaching the outward end of the lower arm 110 to the outward end of the upper arm 111 would provide the most leverage, but require the most vertical travel up the mast to attain the require deployment extension. In some embodiments, the lower arm 110 is attached to the upper arm 111 midway along the upper arm.

The use of cantilever arms in this manner reduces the effort required to lift and deploy the canopy by providing a mechanical advantage. To further assist with the movement required to deploy the canopy, a biasing device may be provided. In the embodiment depicted, a strut 115 is provided to bias the cantilever arms into the deployed position, thereby providing at least some assistance to the movement to lift and deploy the canopy.

Figure 5:
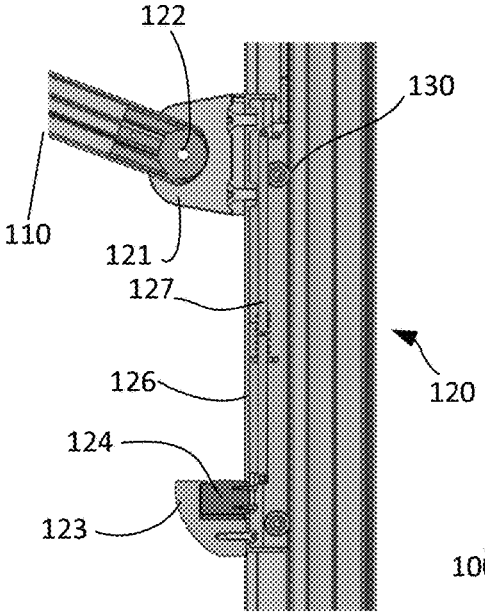
FIG. 5 shows a side sectional view of the carriage 120 within the mast 100.
Figure 6:
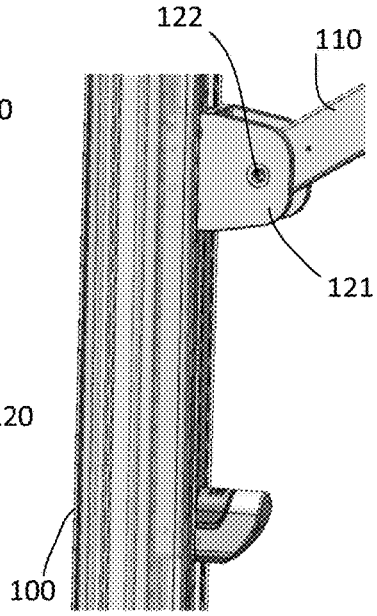
FIG. 6 shows a side section view of the carriage 120 within the mast 100.
Figure 7:
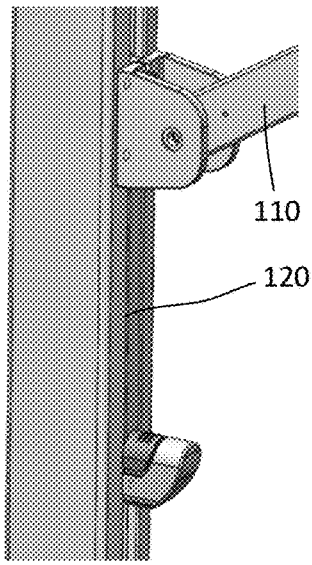
FIG. 7 shows a side view of the of the carriage 120 within the mast 100.

FIGS. 5-7 show an exemplary embodiment of the mast-proximate end of the lower cantilever arm 110 which is supported by a carriage 120. In particular, FIG. 5 shows a side sectional view of the carriage 120 within the mast 100; and FIG. 6 shows a side sectional view of the carriage 120 within the mast 100. FIG. 7 shows a side view of the carriage 120 within the mast 100.

Figure 13:
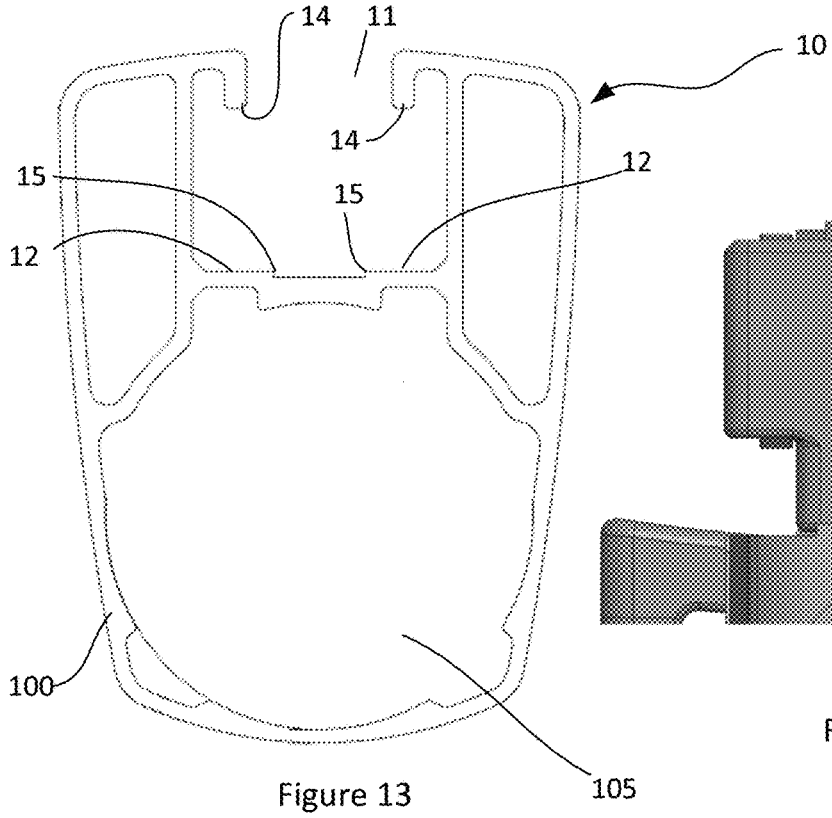
FIG. 13 shows the extrusion profile of the mast 100.

Movement of the carriage is guided by the mast 100. To this end, the mast has an interior region which includes a longitudinally extending channel adapted to support the carriage 120. The channel has an aperture extending from the interior to the exterior of the mast which allows for a point of connection between the carriage and the lower cantilever arm 110 to pass from the mast interior where the carriage is guided, to the exterior where the cantilever arms extend. FIG. 13 shows an example of an extrusion profile of the mast 100 including the channel 11 where the carriage 120 is adapted for travel.

A pivotal attachment point between the carriage 120 and the lower cantilever arm 110 is provided by a clevis 121 which has two flanges spaced apart to allow a pivot pin or axle 122 to pass through each flange. The axle 122 supports pivotal attachment with the lower cantilever arm 110 by passing the axle though a hole in lower portion of the arm. As the carriage is raised and lowered, the axle transfers vertical force to the cantilever arm while allowing the arm to pivot relative to the movement of the carriage.

Figure 8:
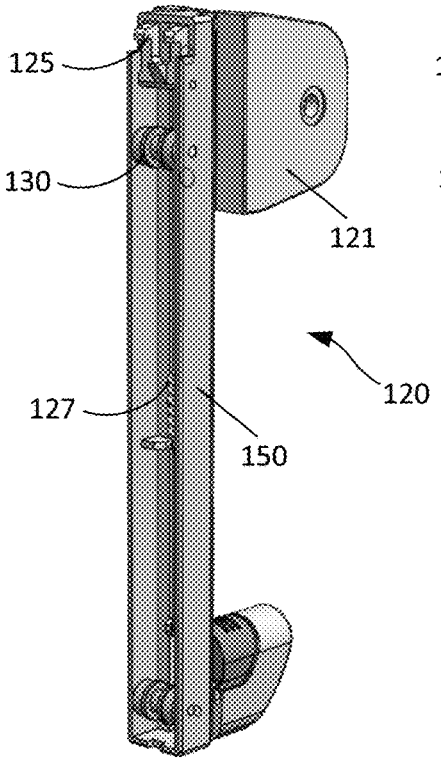
FIG. 8 shows a rear perspective view of the carriage 120.
Figure 9:
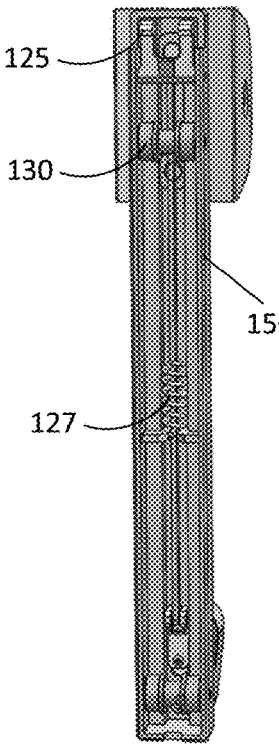
FIG. 9 shows a rear view of the carriage 120.
Figure 10:
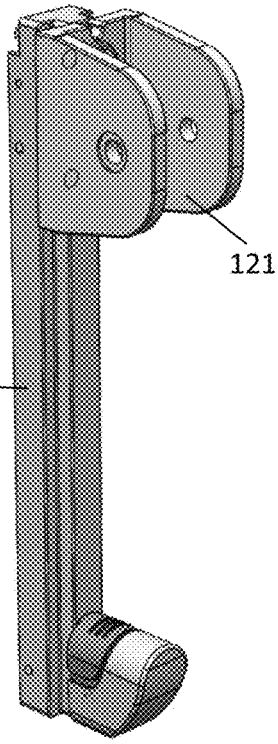
FIG. 10 shows a front perspective view of the carriage 120.
Figure 11:
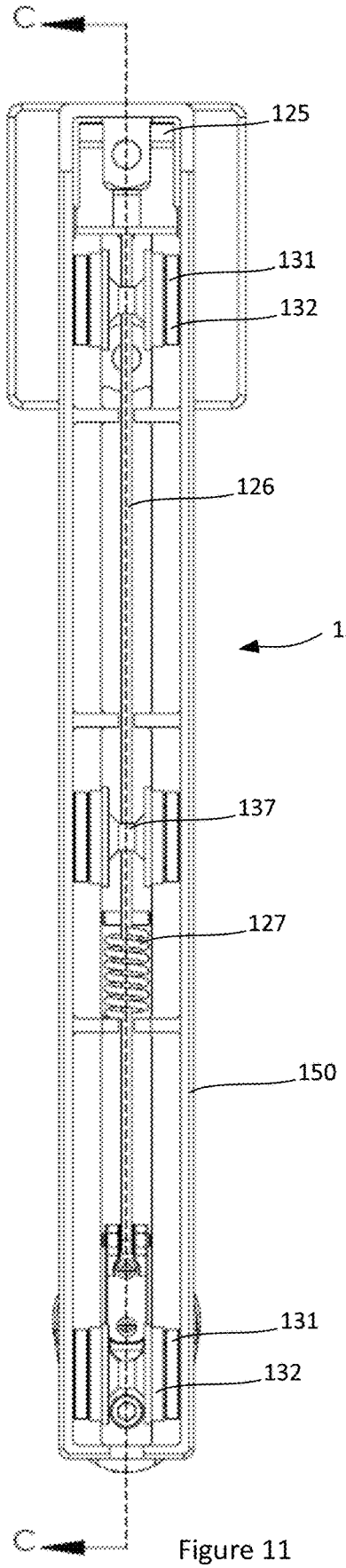
FIG. 11 shows a line drawings of the rear view of the carriage 120.
Figure 12:
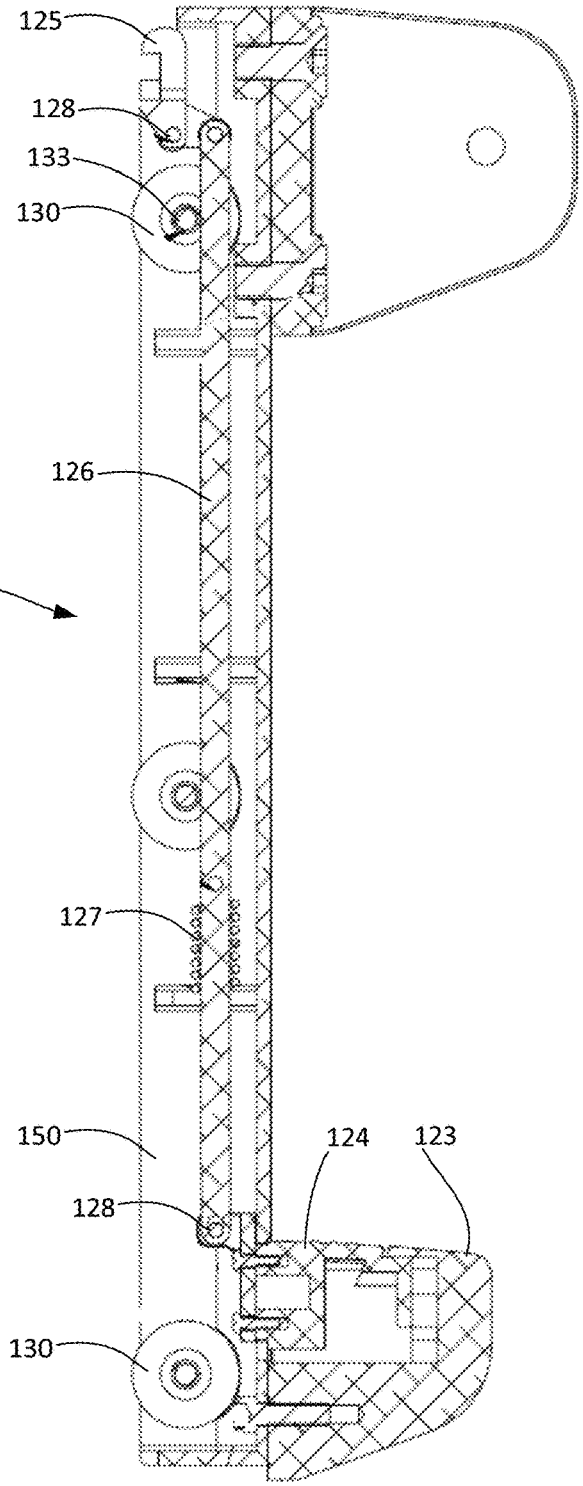
FIG. 12 shows a side view of the section C-C of the carriage shown in FIG. 11.

FIGS. 8-10 show the carriage in some detail. In particular, FIG. 8 shows a rear perspective view of the carriage 120; FIG. 9 shows a rear view of the carriage 120; and FIG. 10 shows a front perspective view of the carriage 120. The carriage has a chassis 150 from which the clevis 121 extends. To facilitate travel within the mast, the carriage has a plurality of wheels rotationally supported by an axle and the chassis. FIG. 11 shows a line drawings of the rear view of the carriage 120 and FIG. 12 shows a side view of the section C-C of the carriage shown in FIG. 11 which is adapted for travel within the mast 100.

To facilitate carriage travel, the wheels of the carriage and profile of the mast channel 11 are complementary in form. The wheels generally comprise of smaller outer wheels running on the inside face of the extrusion and larger central wheels running down the rear of the mast extrusion cavity. Details in the centre of the large wheels allow the pull rod to run the length of the locking carriage, as well as allowing the wheels to run over the lower lock plate. The carriage also has a linkage bar, hook catch, user handle, release button, pins, spring and fixings as well as the pivot bracket. Moving the carriage actuates the through spar to pivot within the main spar in a scissor like motion and thus reduces the distance between the hubs, deploying the ribs.

Referring again to the extrusion profile shown in FIG. 13, the channel 11 has an inner facing interior surface 14 and an outer facing surface 12. The outer facing surface further comprises a depression 13 which forms a pair of ridges 15. The wheels of the carriage comprise a first set of wheel surfaces 132 which have an axially stepped profile. In the embodiment depicted, the step in the profile is complementary to the depression 13 in the outer facing surface of the mast such that the ridges 15 engage with the step in the wheel to substantially align the carriage as it travels within the channel. Those skilled in the art will appreciate that alignment of the carriage within the channel could be provided by many different mechanisms, such as rails and/or other guide wheels.

Figure 14:
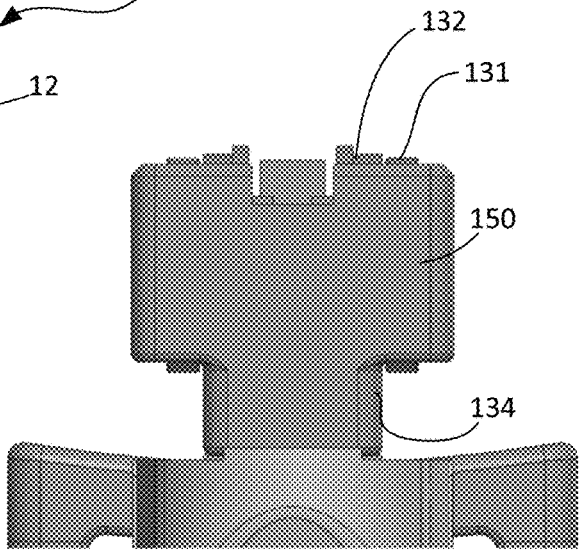
FIG. 14 shows an end view of the carriage 120.

The wheels of the carriage further comprises a second set of wheel surfaces 131 adapted to engage with the inner facing interior surface 14 of the channel 11. Further, the second set of wheels extend from the chassis to engage a surface of the channel that opposes that of the first set of wheels. FIG. 14 shows an end view of the carriage 120 including the opposing wheel protrusion 134 of the second wheel set. In this way, the first set of wheel provide support to the carriage to oppose forces substantially orientated toward the mast, and the second set of wheels provide support to the carriage to oppose forces substantially orientated toward the mast. Such forces change as the carriage is raised and lowered within the mast and the angle of force applied by the lower cantilever arm changes. In this way, movement of the carriage within the channel under such forces allows the carriage to remain substantially friction free. Low friction is advantageous to allow easier deployment of the canopy.

Figure 15:
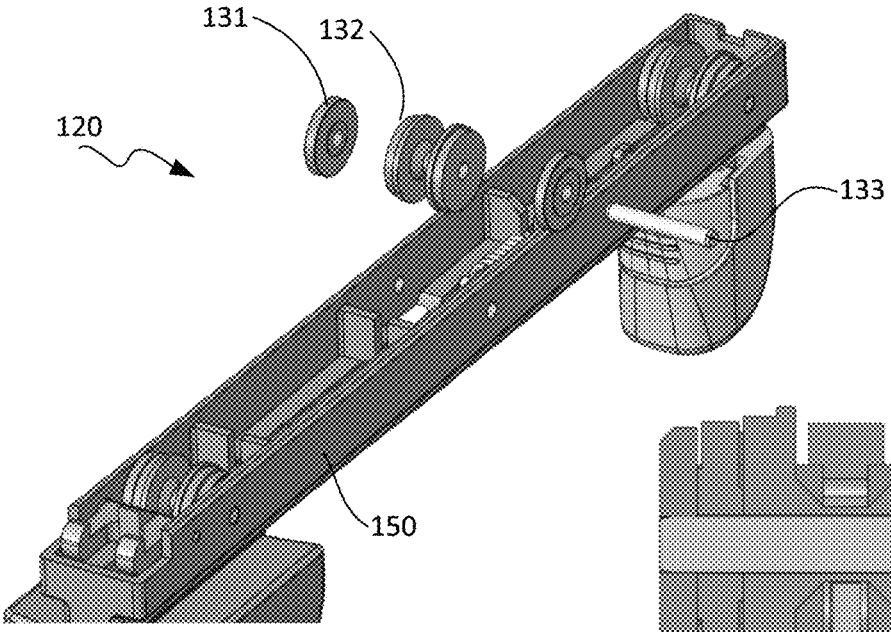
FIG. 15 shows a partly exploded perspective view of the carriage 120 and in particular the arrangement of wheels 131, 132.
Figure 15:
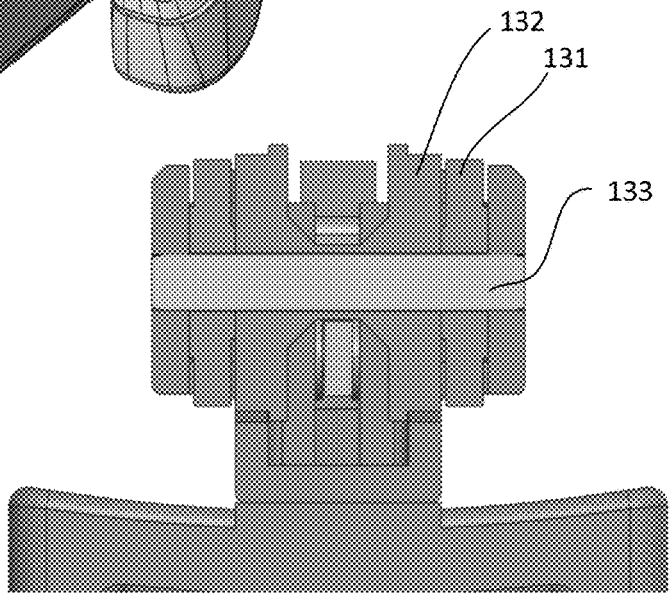

FIG. 15(*a*) shows a partly exploded perspective view of the carriage 120 and in particular the arrangement of wheels 131, 132. FIG. 15(*b*) shows a rear cut away view of the carriage shown in FIG. 14 and the wheels 131, 132 supported by the axle 133. It should be noted that any number of wheel sets may be supported by the chassis. However, three sets as depicted is particularly advantageous. A centrally located set of wheels may provide substantial support to the chassis, while an upper and lower set of wheels help to prevent the carriage from rocking within the channel.

In the embodiment depicted, the wheels 131, 132 are arranged to allow the carriage to track up and down the mast to support movement of the lower cantilever arm. It is therefore envisaged that many other forms of carriage support and/or channel details could be employed. For example, there may be wheels arranged diagonally within a recess or corner of the mast such that axial movement of the carriage is facilitated while radial movement is prevented. In other examples, the carriage may wrap around the mast such that radial movement is prevented.

Figure 16:
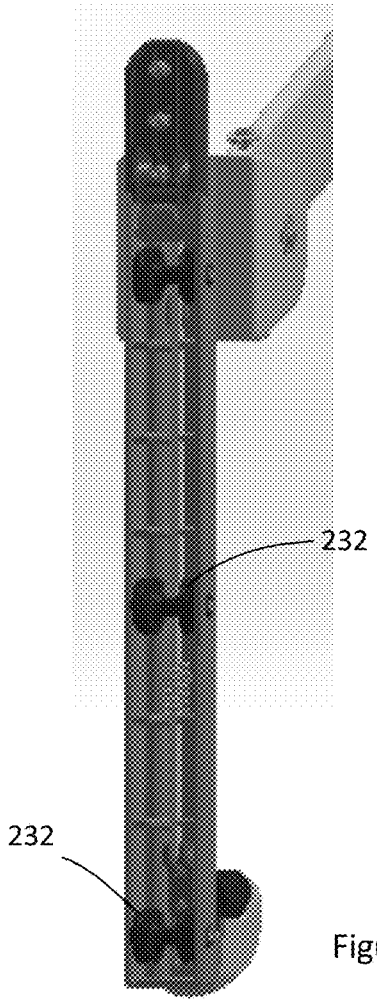
FIG. 16 shows a rear cut away view of the carriage shown in FIG. 14.
Figure 16:
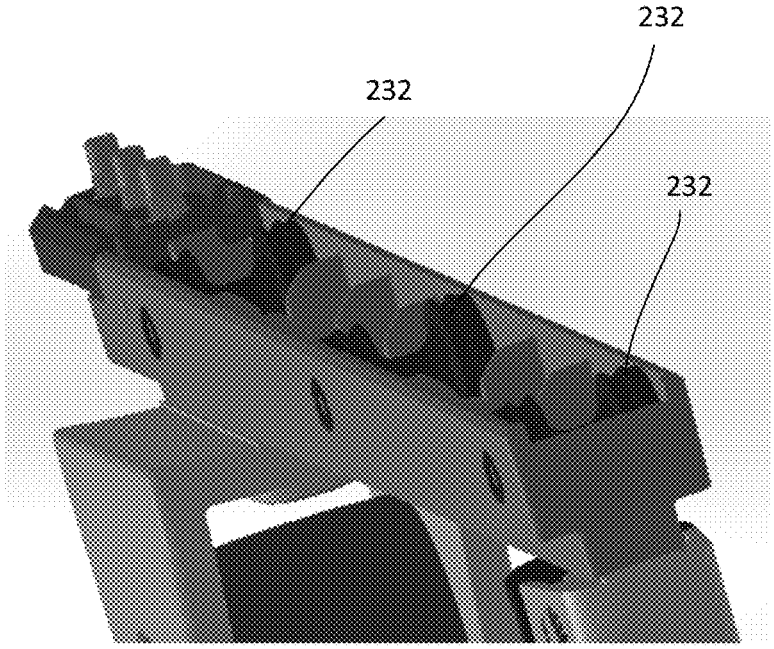

FIG. 16(*a*) and FIG. 16(*b*) show an alternative profile of wheel surface to the one shown in FIG. 15. Shown are vee-shaped wheels 180 which when matched with a channel having a vee-shaped groove, acts to provide guidance and stability to the wheels as the carriage are they are rolled through the channel. Many other forms of wheel and channel surface are possible.

Referring again to FIGS. 5-12, a remote locking or engagement mechanism is shown incorporated into the carriage. The locking mechanism acts to lock and release the vertical position of carriage on the mast. The engagement mechanism has the primary components of a trigger 124 at a lower end of the carriage supported by a trigger housing 123, a hook or locking catch 125 at an upper end of the carriage, a rod 126 operably connected between the trigger 124 and the locking catch 125 so as to link the mechanical displacement of the trigger and the hook. The locking catch 125 rotates toward and away from a vertical face of the mast by rotating about a pivot 128. It should be noted that the rod 126 may be any component that operates to transfer force under tension. Such components include a wire linkage, cam lock, powered switch and actuator.

Figure 18:
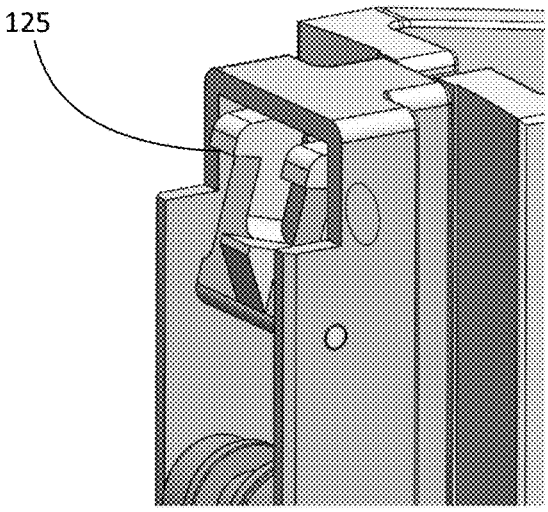
FIG. 18 shows a close up perspective view of the upper portion of the carriage.
Figure 19:
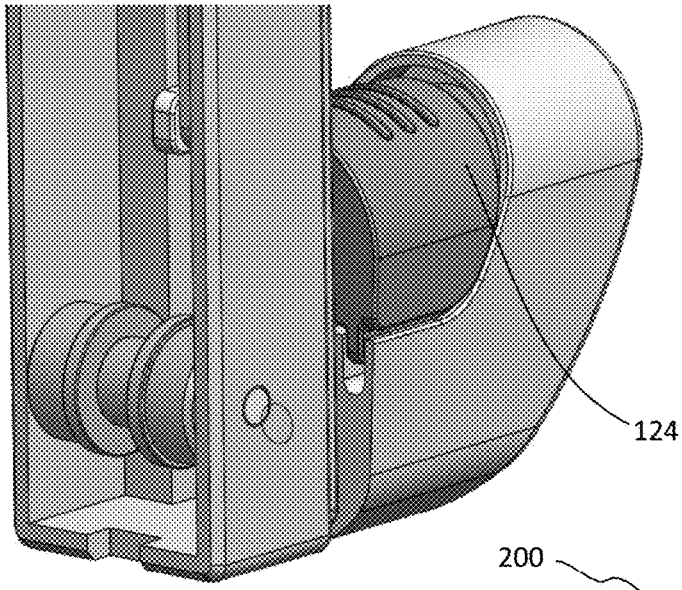
FIG. 19 shows a close up perspective view of the lower portion of the carriage.

The hook engages with the mast to lock the vertical position of the carriage relative to the mast. The locking catch may also be one or more locking catch details configured to engage in a female slot. Preferably the rod 126 causes operation of the trigger and/or locking catch between an engaged position and a disengaged position. A biasing device 127 is adapted to cause the trigger rest in the engaged position. In some embodiments, the biasing device is a spring orientated to act in compression in response to movement of the trigger from a disengaged position. FIG. 18 shows a close up perspective view of the upper portion of the carriage and FIG. 19 shows a close up perspective view of the lower portion of the carriage.

Figure 17:
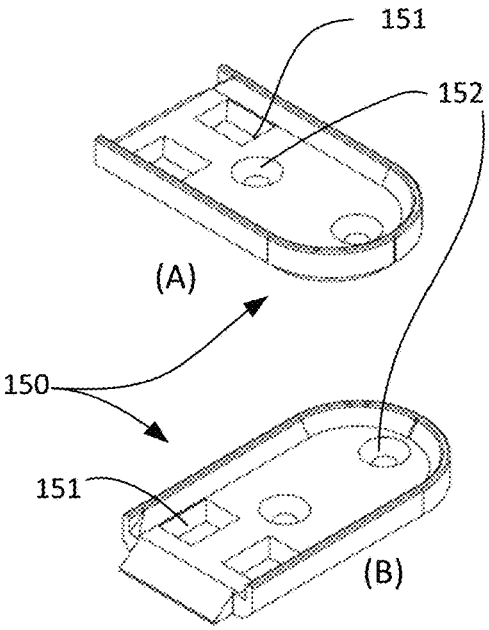
FIGS. 17(A) and (B) show perspective views of a carriage support device 150.

To support operation of the locking catch the mast further comprises a receptacle adapted for engagement with the locking catch, such that, raising the carriage within the channel causes alignment of the locking catch with the receptacle. The receptacle may be any form of mechanical engagement suitable for retaining the locking catch such as an actuated catch, a rotational catch, or an aperture formed in the internal wall of the channel. In other embodiments, a carriage support device is removeably attached to the mast and provides the receptacle. FIGS. 17(A) and (B) show perspective views of an exemplary carriage support device or locking plate 150 that has holes 152 where a fastener may pass to attach the locking plate 150 to the mast. The locking plate 150 and has at least one aperture 151 which are configured for engagement with the locking catch 125. In this way, the carriage support device may be fixed at any vertical position according to the extent of desired canopy deployment desired.

To deploy the cantilever umbrella, the slide carriage is lifted until the locking catch reaches the locking plate. The hook automatically locks the carriage in position by being displaced by the leading edge of the locking catch to compress the biasing device, then releasing when the hook aligns with an aperture 151 and the biasing device releases stored energy. The trigger 124 is at the opposing end of the carriage to the handle to ensure the handle is at the lowest placement when deploying the umbrella, thus making it more accessible to a range of users. In some embodiments, the female slot in the locking plate has an angled profile of 2° or more from horizontal to ensure a safe and secure locking interaction under the weight of the canopy as applied via the lower cantilever arm.

In some embodiments, the carriage locking plate is curved on the top to allow dispersion of rain water away from the slots. In some embodiments, the locking plate and/or the locking catch have a ramped profile to allow the locking catch to slide into place as the carriage is raised without express interaction with the trigger. The ramp puts tension into the locking catch via the biasing device with the stored energy released when the male hook aligns with the female slot. Where a ramp is not used, a user may simply require to hold the trigger down to clear the locking catch.

To release the locking catch from the locking plate, the trigger is pressed in the trigger housing which slides the connecting rod and pivots the locking catch out of the female engagement slot. In some embodiments, the hook has a secondary hook detail which locks the umbrella in the closed position at the bottom of the mast. This acts in a similar manner to the main lock plate but is a slim ramped profile which provides a discreet locking location and for the carriage wheels to travel over the top.

Figure 39:
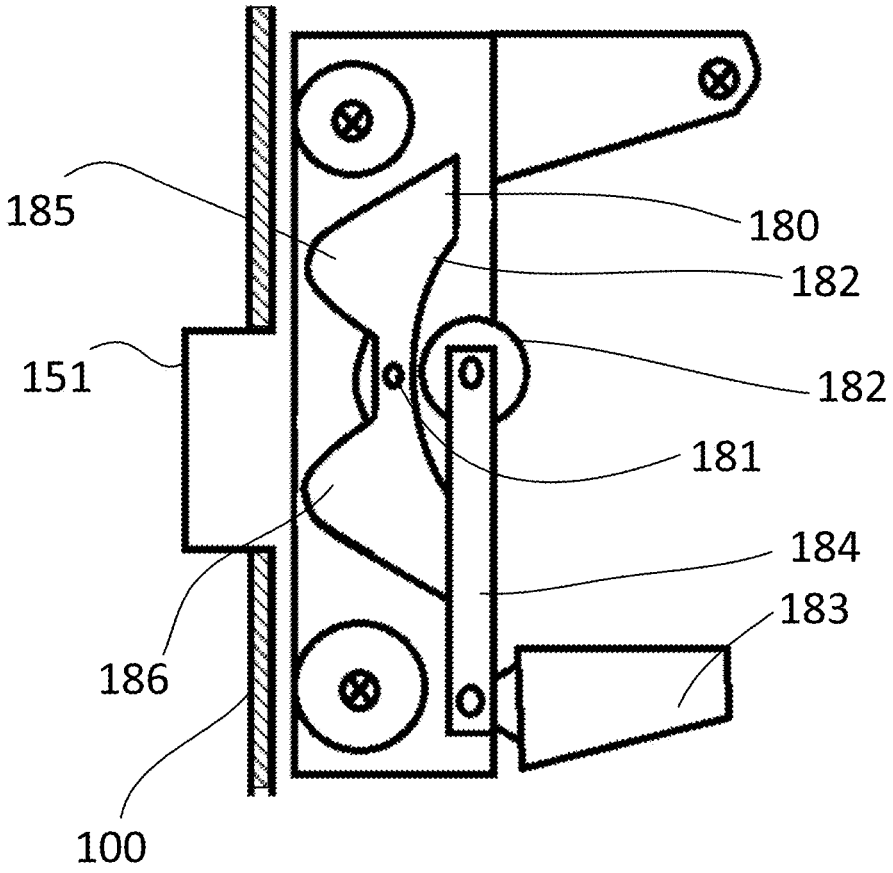
FIG. 39 shows one alternative exemplary embodiment where a cammed lobe facilitates locking of the carriage to the mast at both the deployed and retracted positions.

It should be understood that the locking mechanism discussed above may have many other forms. For example, the above described may be replaced with a pin in aperture; or a rotational cam locking arrangement. FIG. 39 shows one alternative exemplary embodiment where a cammed lobe facilitates locking of the carriage to the mast at both the deployed and retracted positions. Shown is a rocker 180 that pivots about a point 181. The rocker has a cam surface 182 arranged such that force against the surface causes the rocker 180 to pivot around the point 181. A handle 183 is connected to a follower 187 either directly, or indirectly via a linkage 184 as depicted. Movement of the handle causes movement of the follower. The follower is arranged to interface with the cam surface of the rocker such that movement of the handle causes the follower to engage the rocker and cause pivoting about the pivot point 181. The rocker also has a first upper lobe 185 and a second lower lobe 186. Movement of the rocker about the pivot point causes the upper lobe to be displaced toward the mast and the lower lobe to be displaced away from the mast, or vice versa. In this way, movement of the handle one way or the other causes the rocker to pivot such that either the upper or lower lobe is displaced toward the mast. When the follower is in the centre of the cam surface, the lobes are somewhat equidistant from the mast such that neither lobe engages with the mast.

In use, the upper lobe of the rocker is aligned with the upper receptacle of the mast, then is pivoted toward the mast such that the lobe engages with the mast to thereby fasten the carriage to the mast at that location where the canopy is deployed. Further, the lower lobe of the rocker is aligned with the lower receptacle of the mast such that the lower lobe engages with the lower receptacle and the carriage is fixed to the mast at that location where the canopy is retracted. In this way, the movement and direction of displacement of the handle can be visually linked to an engaged or disengaged state of the carriage.

Figure 20:
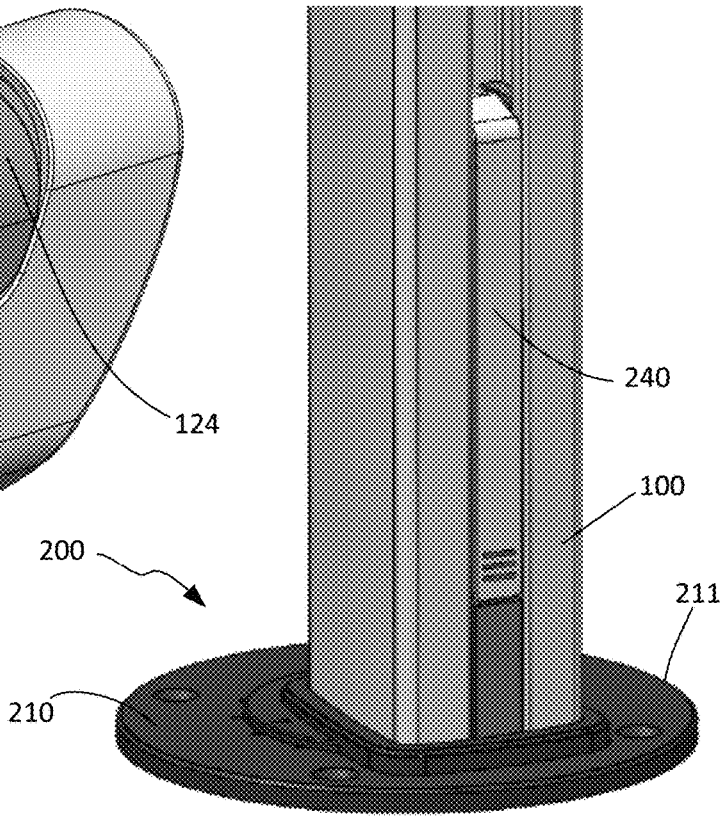
FIG. 20 shows a perspective view of the mast 100 attached to an umbrella mounting assembly.

According to further embodiments, the umbrella 10 also includes an umbrella mounting assembly adapted to support the upstanding mast 100. FIG. 20 shows a perspective view of the mast 100 attached to an umbrella mount 200. The mast 100 has an interior that comprises the longitudinally extending channel 11, and also a second longitudinally extending channel 105. The first channel, as discussed above, has an aperture extending from the interior to the exterior of the mast and guides movement of the abovementioned carriage.

Figure 21:
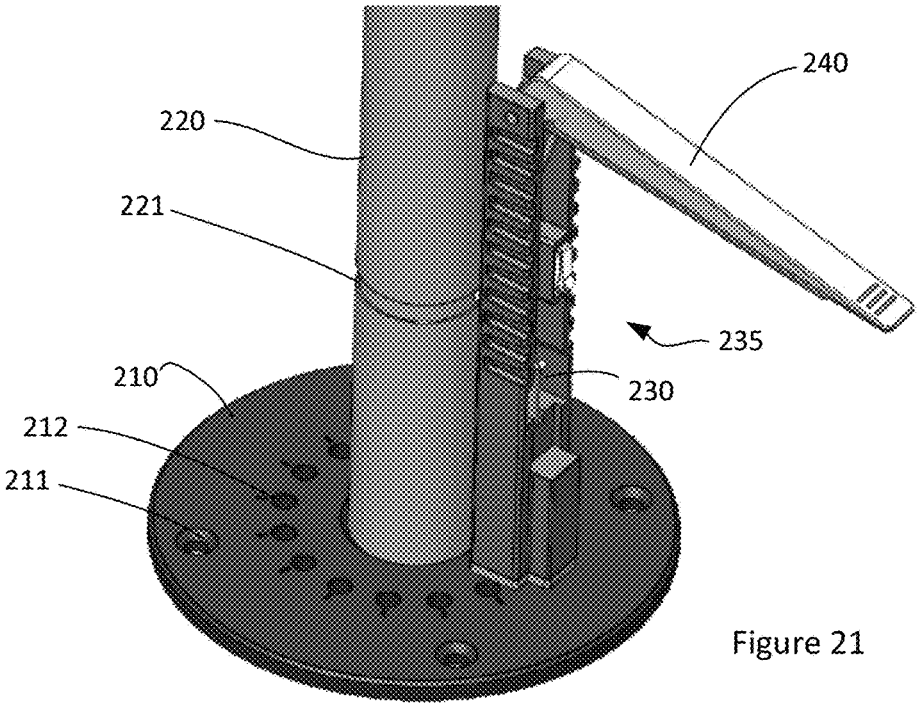
FIG. 21 shows a perspective view of the umbrella mount.

FIG. 21 shows a perspective view of the umbrella mount with the mast not shown. The umbrella mount has components including a base plate 210 and a vertical support member or spigot 220 which is attached to the base plate. The vertical support may be attached to the base plate by any conventional method such as welding or moulding. The base plate is adapted to support the vertical member 220 and has a number of apertures 211 that extend through the plate enabling a fastener to pass to secure the plate to the ground. The vertical member 220 is of a size adapted to be received by the second longitudinally extending aperture 105 of the mast 100, and will allow the mast to rotate about the vertical member.

A locking assembly 235 is shown aligned with the vertical member. The locking assembly has an outer form adapted for fitment within the channel 11 of the mast and operates to selectively fix the rotational position of the mast relative to base assembly. In use, the locking assembly is fixed within the mast channel 11 and acts to lock the rotational position of the mast which is otherwise free to rotate about the vertical support 220.

The base plate has a second set of apertures 212 provided to allow for engagement with the locking assembly 235. The locking assembly allows rotation of the mast 100 about the support member 220 when in an unlocked configuration, and locks the mast to the base plate then in a locked configuration. The locking assembly 235 thereby allows selective fixation of the mast rotation about the support member 220.

Figure 22:
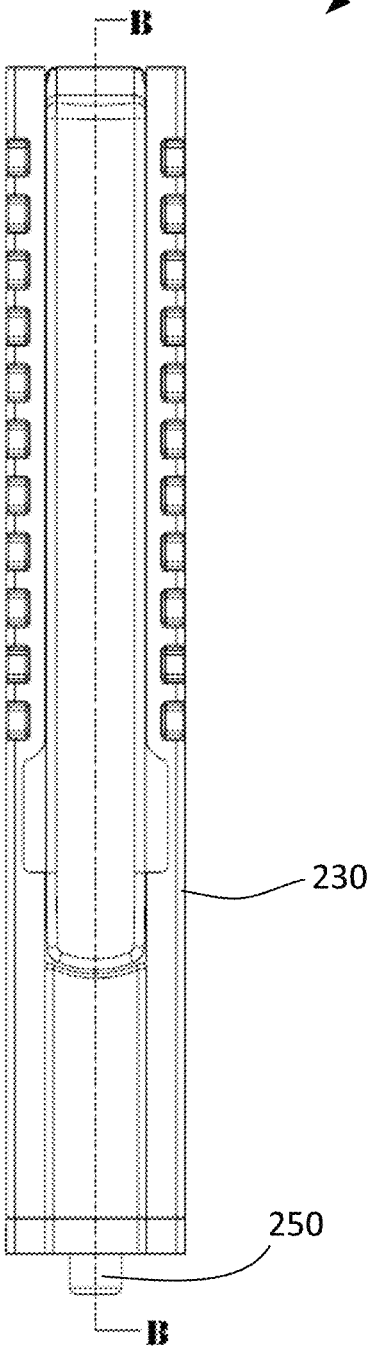
FIG. 22 shows a front view of a locking assembly.
Figure 23:
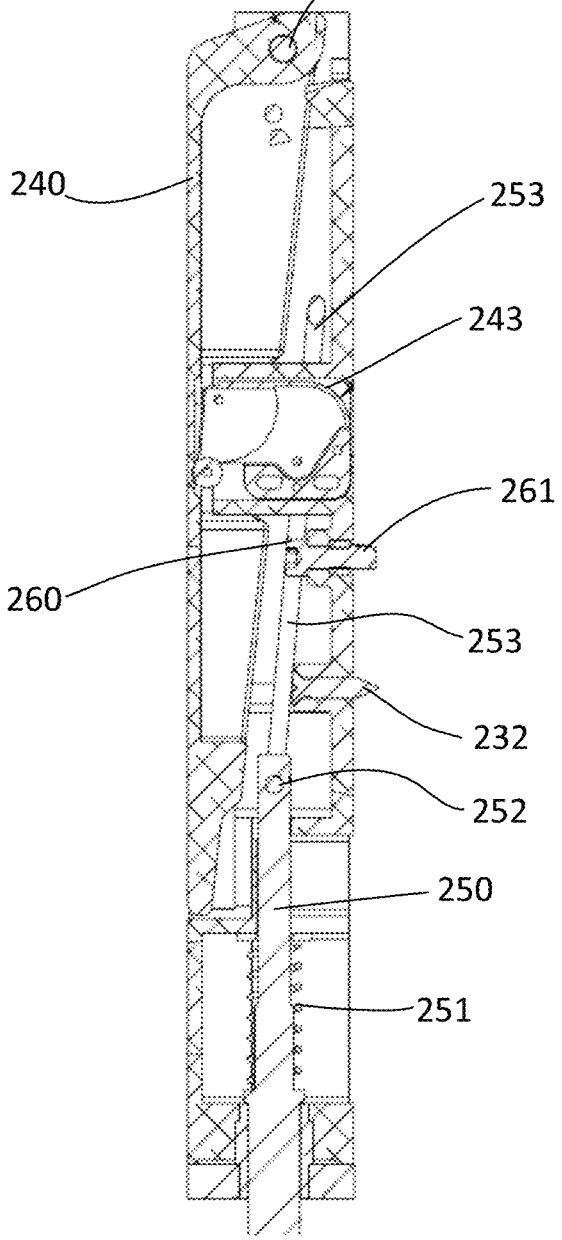
FIG. 23 shows a section view of the locking assembly.
Figure 24:
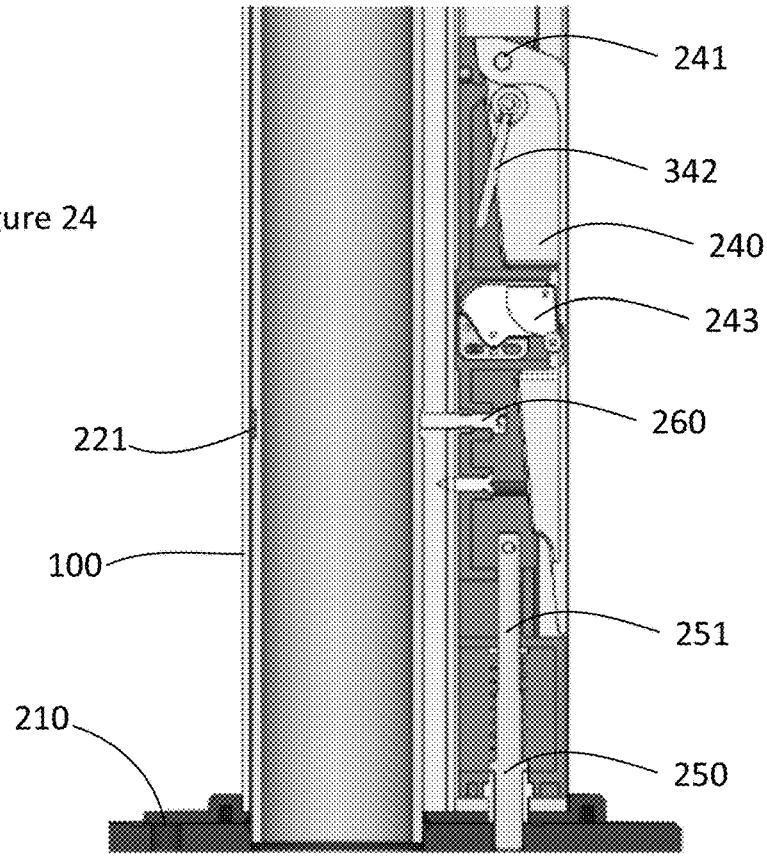
FIG. 24 shows a side section view of the umbrella mounting assembly in a locked configuration.
Figure 25:
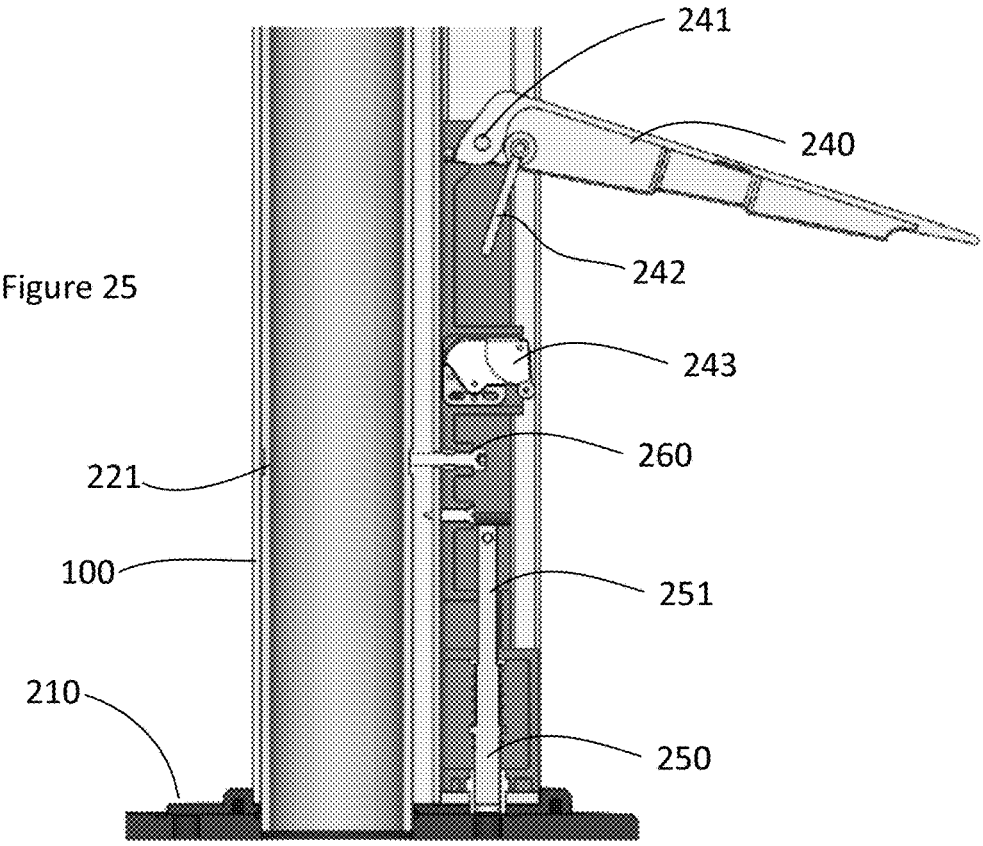
Figure 26:
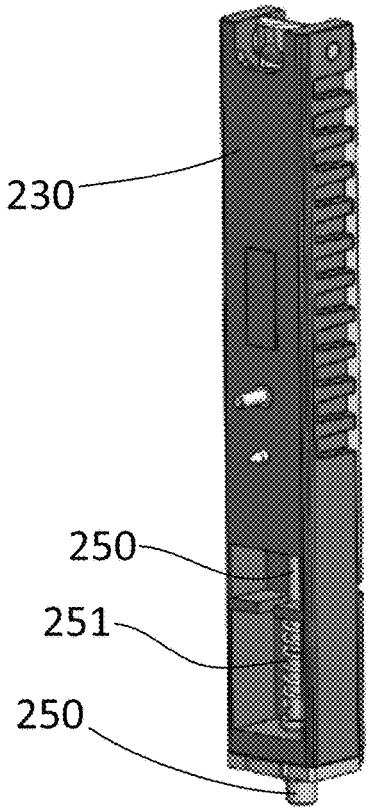
FIG. 26 shows a rear perspective view of the locking assembly in a locked state.
Figure 27:
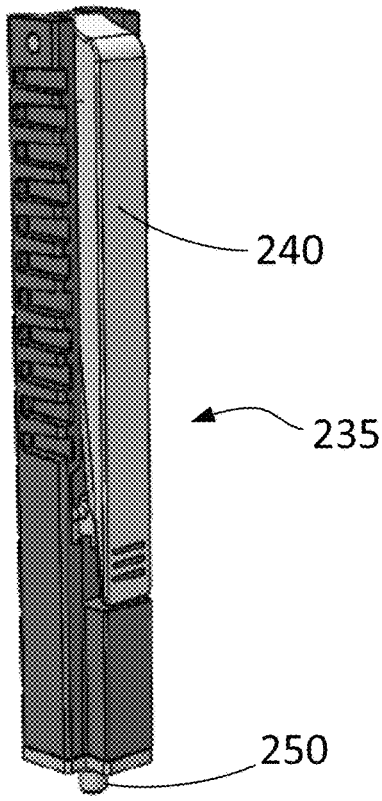
FIG. 27 shows a front perspective view of the locking assembly in a locked state.
Figure 28:
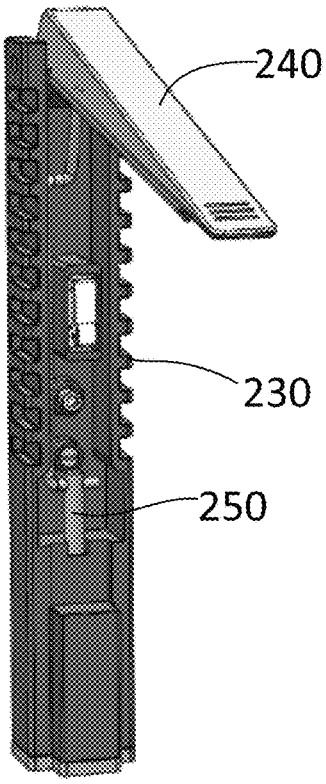
FIG. 28 shows a front perspective view of the locking assembly in an unlocked state.
Figure 29:
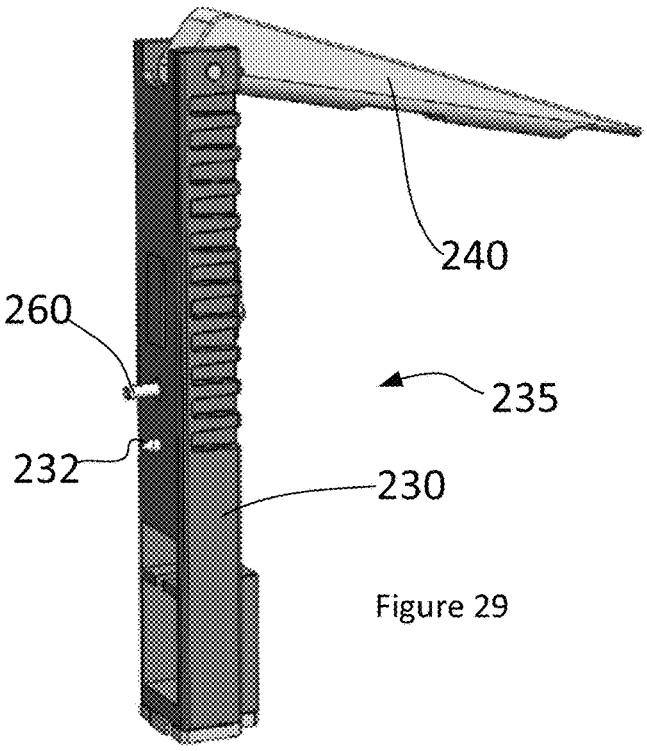
FIG. 29 shows a rear perspective view of the locking assembly in an unlocked state.

FIGS. 22-29 show views of the locking assembly 235. In particular, FIG. 22 shows a front view of a locking assembly; FIG. 23 shows a section view BB of the locking assembly shown in FIG. 22; FIG. 24 shows a side section view of the umbrella mounting assembly in an unlocked configuration; FIG. 24 shows a side section view of the umbrella mounting assembly in a locked configuration; FIG. 26 shows a rear perspective view of the locking assembly in a locked state; FIG. 27 shows a front perspective view of the locking assembly in a locked state; FIG. 28 shows a front perspective view of the locking assembly in an unlocked state; and FIG. 29 shows a rear perspective view of the locking assembly in an unlocked state.

Referring to FIGS. 22 and 23, the locking assembly 235 has a housing 230, a latching mechanism supported by the housing, and a pin 250 that extends from the housing to engage with the base plate 210. The pin supported within the housing and actuated by the latching mechanism between at least engaged and disengaged positions. In the disengaged position, the pin is raised or positioned above the base. In the engaged position, the pin is displaced from the housing and engaged with one of the base plate apertures 212. The pin is orientated within the housing for axial alignment with the plurality of apertures of the base plate such that movement in the axial plane causes transition between the engaged and disengaged positions.

To cause movement of the pin, the latching mechanism is supported by the housing and has components including a lever arm 240 pivotally connected to the housing at one end. The lever is connected to a rod 253 which causes displacement of the pin 250 as the lever is raised and lowered. In some embodiments, a biasing device 251, such as a spring, is provided to cause displacement of the pin into the engaged position when the lever is not being lifted. In this way, the mast may be rotated around the base plate and the pin will be automatically engaged with one of the base plate apertures 212 when alignment occurs.

The lever arm is preferably secured within the housing of the locking mechanism and mast when not in use. A releasable catch may be employed to provide the desired position of the catch. FIG. 25 shows a catch 243 released from the lever arm, while FIG. 24 shows the catch 243 securing the lever arm within the housing. FIG. 20 shows the external appearance of the lever arm when not in use—in this instance, flush with the outer surface of the mast so as not to cause an undesired or unsafe protrusion.

The housing 230 is of a form adapted to be received the second longitudinally extending channel of the mast. In this way, the housing is able to be fixed inside the outer profile of the mast to thereby avoid any components which protrude from the mast. The lever arm is of a form such that it may extend through the aperture of the second longitudinally extending channel to be accessed externally. In this way, the lever may be moved on the exterior of the mast, while the pin is moved on the inside of the mast. FIGS. 26 and 27 show the lever in the downward position and the pin 250 protruding from the lower extent of the housing 230 where it may engage with the base plate.

The housing 230 of the locking assembly 235 is fixed to the mast extrusion interior by any conventional means of attachment. In the embodiment depicted, a fastener 232 extends through the housing and mast interior wall to fix these components together.

It is desirable for the mast to be secured to the base plate so that gusts of wind do not lift or destabilise the umbrella. To secure the mast and locking assembly to the vertical support of the base, yet allow rotation of the mast about the vertical support, the vertical support has a circumferential groove 221 in the outer surface thereof at a location vertically displaced from the base plate—observable in FIGS. 21, 24 and 25. In turn, the locking assembly 235 has a spigot 260 extending from the housing 230. The spigot 260 is vertically aligned with the circumferential groove and has a tip portion 261 engage within the groove. In this way, the locking mechanism and mast may be rotated around the vertical support and the tip portion 261 of the spigot 260 travels within the circumferential groove. However, vertical displacement of the mast is prevented by vertical occlusion of the spigot by the upper and lower extents of the groove. In some embodiments, the spigot is merely a fastener that may be installed once the mast is positioned onto the vertical support.

According to further embodiments, the umbrella 10 also includes the hubs 300, 301 which locate the many ribs 112, 114 that support the canopy. The hubs act as a central location from which a selection of ribs will span. The ribs are connected to the hub by a pivot device such as a pin in slot. However, there are a variety of embodiments that differ in the number of ribs desired to support a canopy. For example, in some embodiments, a square or octagonal canopy form is desired, necessitating the ribs to radiate from the hub with a separation angle of 45 degrees. In other embodiments, a rectangular canopy form is desired, necessitating the ribs to radiate from the hub at 45 and a different separation angle according to the desired layout of spars to support a desired canopy form. Particular angles at which ribs extend from the hub will be necessary in some circumstances to support a desired canopy form. It is therefore desirable to have a single hub component 300, 301 that will support all, or at least a selection of desired canopy forms without the requirement for several hub components specifically designed for to support a particular canopy form.

In some embodiments, the main hub of the umbrella is utilised at the top and the bottom of the canopy and rib assembly. The hub is a clamshell design constructed from an upper and lower part but could also be formed in two or more pieces and joined to form a unitary body. The parts may be fixed together by any conventional means such as glue, clips, screws or bolts. A ledge or support shape is created around the periphery of the hub which accepts the pin or axle details of the ribs. These channel details are formed in two planes which allows two or more location options for the receiving pivot axle thus allowing a single hub to be used for multiple canopy shape and style options.

For example, a channel at 45° to the main spar is suitable for square and octagonal shaped canopies. A channel between 10° and 35° to the perpendicular axis of the main spar will allow rectangular shaped canopy to be formed.

The hub can be formed from any cast metal or injection moulded plastic which allows receiving channels to be formed. The number of channels around the hub can number between four and twelve. As well as the receiving details for the ribs, one half of the hub construction also has receiving details for the main spars. This can be in the form of a single prong with the main spar saddling the prong, it could be a 2-pronged design with the main spar nestled in between the prongs but it could also be any number of prongs or support channels.

Figure 30:
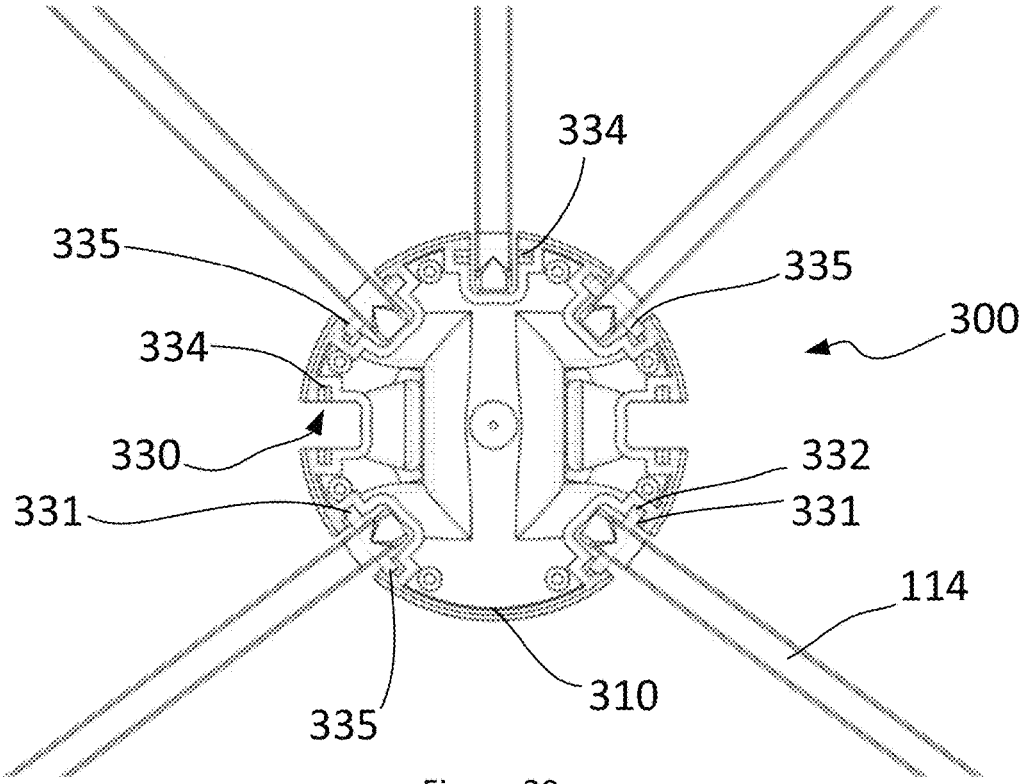
FIG. 30 shows a plan view of a hub according to a an exemplary embodiment.
Figure 31:
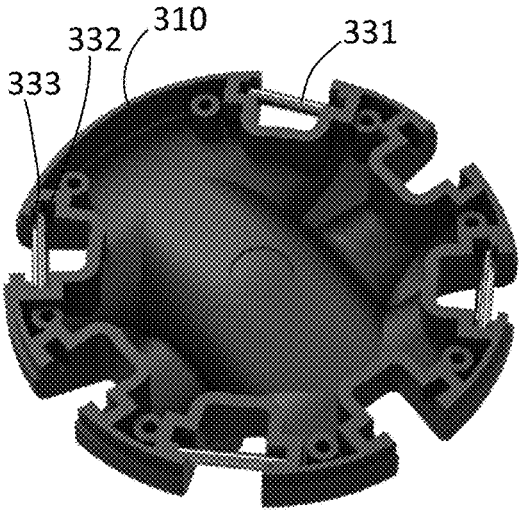
FIG. 31 shows a perspective view of a portion of a hub housing.
Figure 32:
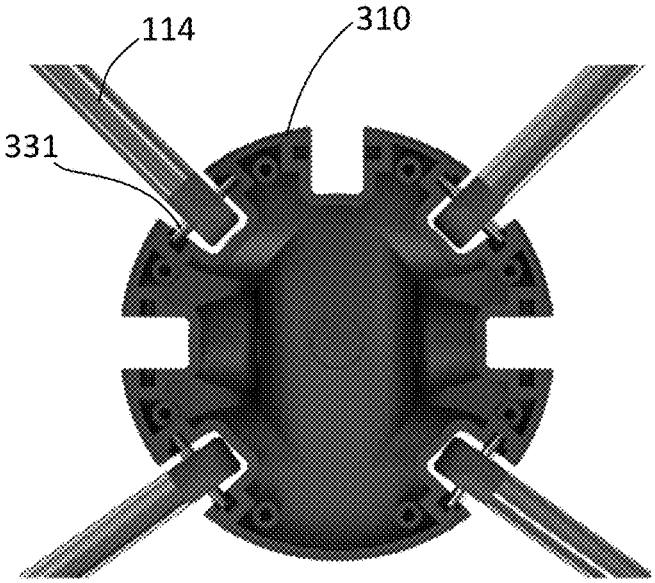
FIG. 32 shows a plan view of a portion of the hub housing supporting ribs.
Figure 33:
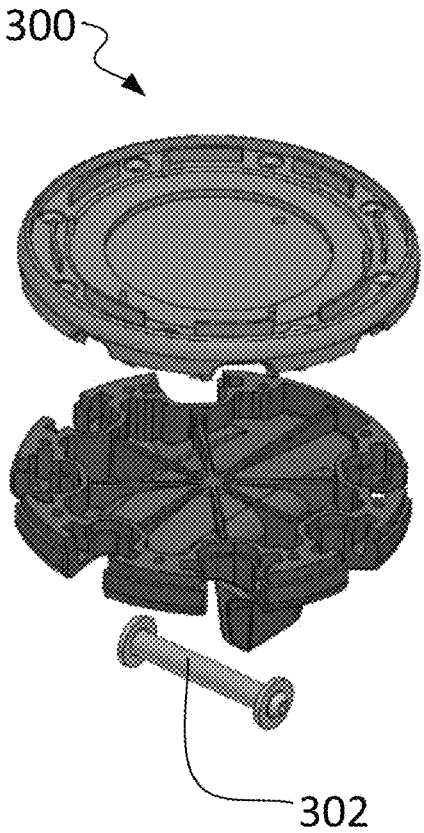
FIG. 33 shows an exploded perspective view a hub according to another embodiment.
Figure 34:
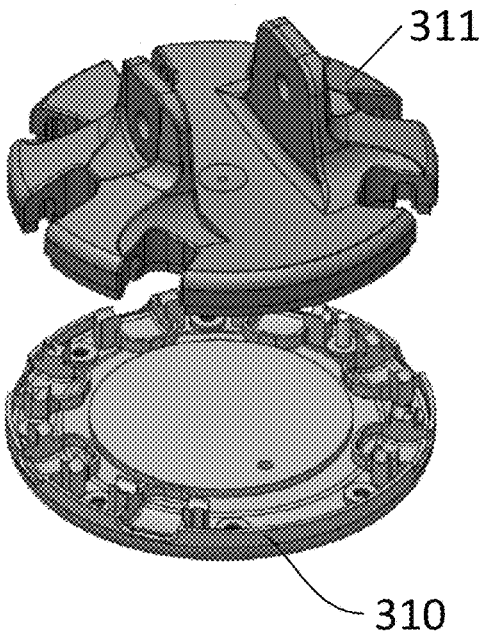
FIG. 34 shows an exploded perspective view a hub according to another embodiment.
Figure 35:
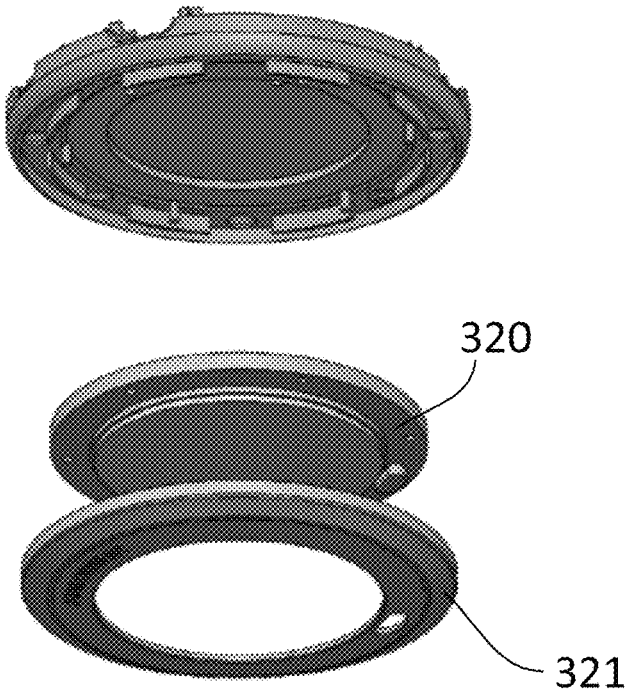
FIG. 35 shows an exploded perspective view a hub according to another embodiment.

FIGS. 30-35 illustrate a hub according to an embodiment that supports a range of possible angles which the ribs are able to radiate from the hub. In particular, FIG. 30 shows a plan view of a hub according to one exemplary embodiment; FIG. 31 shows a perspective view of a portion of a hub housing; FIG. 32 shows a plan view of a portion of the hub housing supporting ribs; FIG. 33 shows an exploded perspective view a hub according to another embodiment; FIG. 34 shows an exploded perspective view a hub according to another embodiment; and FIG. 35 shows an exploded perspective view a hub according to another embodiment.

Referring to FIG. 30, a plan view of an exemplary hub 300 is shown with a plurality of spars 114 radiating from the hub. The hub body has a plurality of channels adapted to receive a pin 331, 335 orientated perpendicular to the orientation of and for the support of a radiating rib. At least some channels comprise an amalgamation of at least a first slot form and second slot form, wherein the first slot form is orientated perpendicular to a 45 degree separation angle of rib radiation, and the second slot form is orientated perpendicular to a 35 degree separation angle of rib radiation. These two angles in particular support square and rectangular canopy forms. The hub has a plurality of openings 330 adapted to receive a rib 114 mounted to the hub 300, 301 by a pin 331 that passes through the rib and pressed into a channel 332. Some channels 334 support a rib to radiate perpendicularly outward from the hub, or 45 degrees from a hub centreline. Other channels 335 support a rib to radiate either 45 or 35 degrees from the hub centreline.

The hub body may be formed from several components that are bought together. For example, FIG. 33-35 show an exemplary embodiment where the hub body has two sections 310, 311 bought together in a clam shell configuration to close the channels.

In some embodiments, the hub includes one or more devices such as electronic gadgets.

For example, FIG. 35 shows an exploded view of a hub including a light 320 mounted using a shroud 321. Other devices include a speaker, heater, and/or solar panel integrated into the hub centre.

Figure 36:
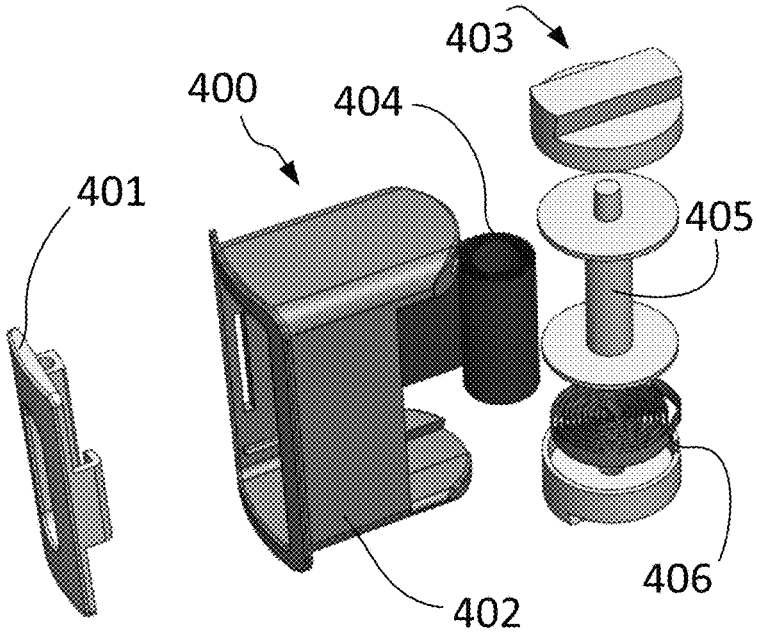
FIG. 36 shows the securement device is shown in an exploded view.
Figure 37:
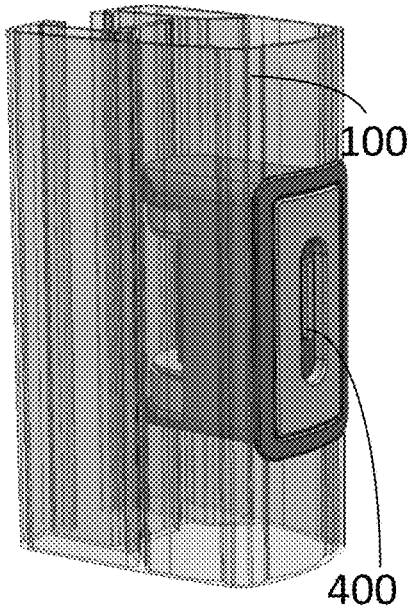
FIG. 37 shows the securement device positioned within the interior channel of the mast.
Figure 38:
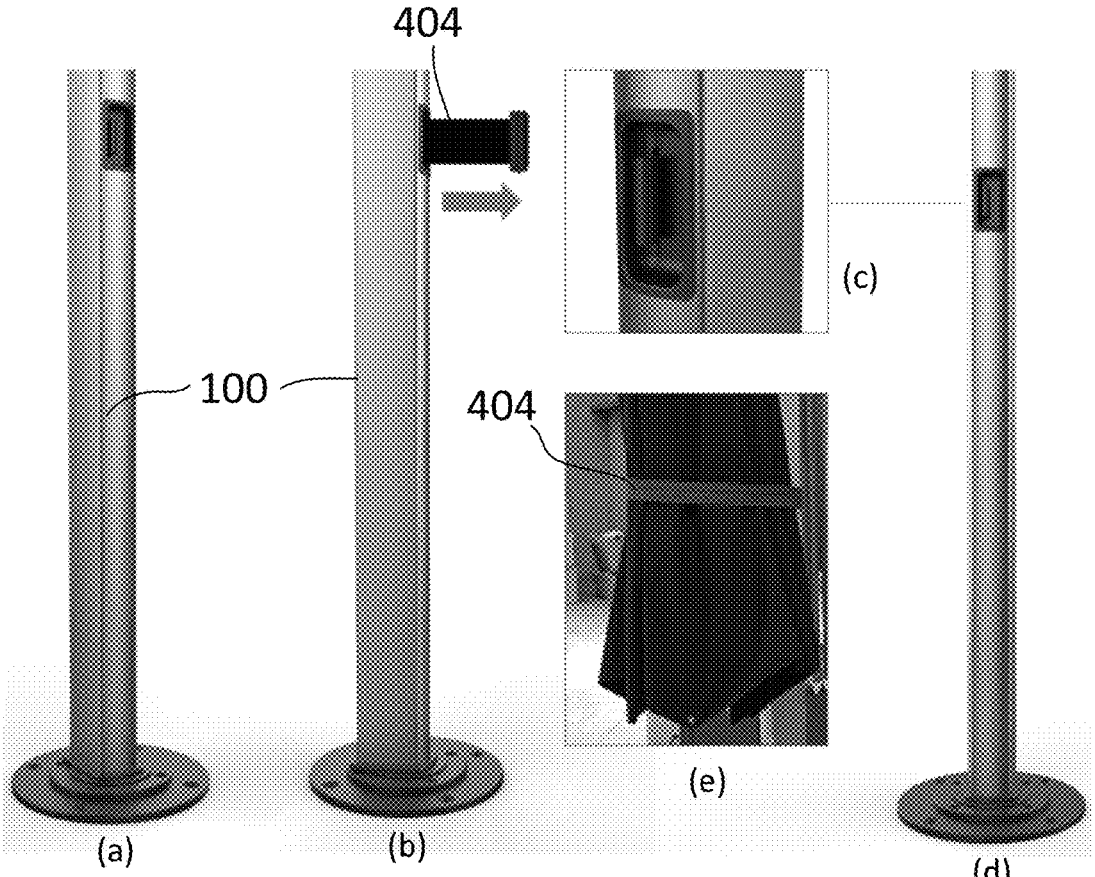
FIG. 38 (*a*)-(*e*) show forms of the securement device in use.

FIGS. 36-38 show a further embodiment including a securement device for the umbrella canopy when the canopy is retracted. Securing of the canopy is useful for both aesthetic and functional considerations of keeping the canopy neat and tidy when the umbrella is not in use.

FIG. 36 shows the securement device 400 is shown in an exploded view; FIG. 37 shows the securement device positioned within the interior channel of the mast 100; and FIG. 38 shows (a)-(e) show forms of the securement device in use.

The securement device 400 has a strap 404 wound onto a spindle 405. In some embodiments, the strap is mechanically biased onto the spindle by a clock spring 406. The spindle and strap are contained within a housing 402 with an entry cover 401. The housing 402 is adapted for fitment into the interior region of the mast 100 as shown by FIG. 37. In use, the strap is retrieved from the housing and pulled from the spindle, looped around a lowered canopy, and secured. FIG. 38(*e*) shows the strap 404 wrapped around a retracted canopy 410. The strap loop may be secured by any number of fastening techniques.

It is to be understood that the present invention is not limited to the embodiments described herein and further and additional embodiments within the spirit and scope of the invention will be apparent to the skilled reader from the examples illustrated with reference to the drawings. In particular, the invention may reside in any combination of features described herein, or may reside in alternative embodiments or combinations of these features with known equivalents to given features. Modifications and variations of the example embodiments of the invention discussed above will be apparent to those skilled in the art and may be made without departure of the scope of the invention.

Preferred Features

An assembly adapted to support an upstanding mast, the mast comprising an interior region and wherein the interior region comprises a first longitudinally extending channel and a second longitudinally extending channel, the first longitudinally extending channel comprising an aperture extending from the interior to the exterior of the mast; the assembly comprising:

a base assembly comprising a base plate and a vertical support member extending from the base plate; the base plate having a plurality of apertures located about the vertical support member, and the vertical support of a form adapted to rotatably receive the second longitudinally extending channel of the mast; and a locking assembly comprising a housing, a latching mechanism, and a pin; the pin supported within the housing and adapted for displacement by the latching mechanism between at least an disengaged position and a engaged position, and orientated within the housing for axial alignment with the plurality of apertures of the base plate; and wherein the housing is of a form adapted to be received the first longitudinally extending channel of the mast, and the latching mechanism is configured to extend through the aperture of the second longitudinally extending channel to thereby allow the pin to be moved at least from the engaged to the disengaged position.

The assembly as claimed in any preceding claim, wherein the locking assembly further comprises one or more fasteners adapted to fix the housing into the first longitudinally extending channel of the mast.

The assembly as claimed in any preceding claim, wherein the vertical support member comprises a circumferential groove in the outer surface thereof at a location vertically displaced from the base plate; and the locking mechanism further comprises a spigot adapted to extend from the housing and into the circumferential groove to thereby prevent vertical movement of the mast relative to the vertical support member, yet allow rotation of the mast relative to the vertical support member.

The assembly as claimed in any preceding claim, wherein the latching mechanism comprises a pivot and a lever extending from the pivot; and the lever is pivotably attached to the pin such that raising the lever raises the pin, and lowering the levers lower the pin; and whereby the pin, when lowered, engages with the apertures of the base plate to thereby prevent rotation of the mast relative to the base plate.

The assembly as claimed in any preceding claim, wherein the latching mechanism further comprises a catch operable to retain the lever in a lowered position whereby the lever is housed substantially within the second channel of the mast.

The assembly as claimed in any preceding claim, wherein the carriage is configured to travel on the mast between a raised and lowered position, the carriage pivotally connected to the cantilever arm by a support arm such that raising the carriage on the mast to the raised position causes the cantilever to transition to the open position, and lowering of the carriage to the lowered position causes the cantilever to transition to the closed position;

wherein the mast comprises at least one receptacle and the carriage comprises an engagement mechanism configured to selectively lock the carriage to the at least one receptacle, the engagement mechanism comprising:

a locking component configured to transition between an engaged position, when substantially aligned with the receptacle, and an disengaged position.

The assembly as claimed in any preceding claim, wherein according to any preceding claim, wherein further comprising a hub body adapted to provide support for a plurality of radiating ribs of an umbrella, the hub body comprising a plurality of channels adapted to receive a pin orientated perpendicular to the orientation of and for the support of a radiating rib;

wherein at least some channels comprise an amalgamation of at least a first slot form and second slot form, wherein the first slot form is orientated perpendicular to a 45 degree separation angle of rib radiation, and the second slot form is orientated perpendicular to another separation angle of rib radiation.

The assembly as claimed in any preceding claim, wherein the umbrella further comprises a canopy configured to drape substantially alongside the mast in at least a retracted form; and a retractable strap contained within the interior region, the strap adapted to pass through the aperture and envelope the canopy in the retracted form to thereby secure the canopy.

A hub body adapted to provide support for a plurality of radiating ribs of an umbrella, the hub body comprising a plurality of channels adapted to receive a pin orientated perpendicular to the orientation of and for the support of a radiating rib;

wherein at least some channels comprise an amalgamation of at least a first slot form and second slot form, wherein the first slot form is orientated perpendicular to a 45 degree separation angle of rib radiation, and the second slot form is orientated perpendicular to another separation angle of rib radiation.

The hub body according to any preceding claim, wherein the hub body comprises an upper body component and a lower body component adapted to come together in a clamshell formation, wherein at least one of upper or lower the body components is adapted to close the channels.

The hub body according to any preceding claim, wherein the hub body includes one or more of a light, speaker, heater, energy storage and/or charging circuits.

The hub body according to any preceding claim, wherein the hub body is incorporated into an umbrella comprising an upstanding mast and a cantilever arm adapted to support a canopy, the cantilever arm pivotally attached to the mast at an upper portion and configured to pivot between an open position where the canopy is deployed and where the cantilever arm extends away from the mast, and a closed position where the canopy is withdrawn and the cantilever arm extends close to the mast;

a carriage configured to travel on the mast between a raised and lowered position, the carriage pivotally connected to the cantilever arm by a support arm such that raising the carriage on the mast to the raised position causes the cantilever to transition to the open position, and lowering of the carriage to the lowered position causes the cantilever to transition to the closed position.

The hub body according to any preceding claim, wherein a carriage is configured to travel on the mast between a raised and lowered position, the carriage pivotally connected to the cantilever arm by a support arm such that raising the carriage on the mast to the raised position causes the cantilever to transition to the open position, and lowering of the carriage to the lowered position causes the cantilever to transition to the closed position; and wherein the mast comprises at least one receptacle and the carriage comprises an engagement mechanism configured to selectively lock the carriage to the at least one receptacle, the engagement mechanism comprising:

a locking component configured to transition between an engaged position, when aligned with the receptacle, and an disengaged position, and a biasing component operable to bias the locking component into the engaged position when aligned with the at least one receptacle.

The hub body according to any preceding claim, wherein the carriage is configured to travel on the mast between a raised and lowered position, the carriage pivotally connected to the cantilever arm by a support arm such that raising the carriage on the mast to the raised position causes the cantilever to transition to the open position, and lowering of the carriage to the lowered position causes the cantilever to transition to the closed position;

wherein the mast comprises at least one receptacle and the carriage comprises an engagement mechanism configured to selectively lock the carriage to the at least one receptacle, the engagement mechanism comprising:

a locking component configured to transition between an engaged position, when substantially aligned with the receptacle, and an disengaged position.

The hub body according to any preceding claim, wherein the mast further comprises an interior region and wherein the interior region comprises a first longitudinally extending channel and a second longitudinally extending channel, the first longitudinally extending channel comprising an aperture extending from the interior to the exterior of the mast; the assembly comprising:

a base assembly comprising a base plate and a vertical support member extending from the base plate; the base plate having a plurality of apertures located about the vertical support member, and the vertical support of a form adapted to rotatably receive the second longitudinally extending channel of the mast; and a locking assembly comprising a housing, a latching mechanism, and a pin; the pin supported within the housing and adapted for displacement by the latching mechanism between at least an disengaged position and a engaged position, and orientated within the housing for axial alignment with the plurality of apertures of the base plate; and wherein the housing is of a form adapted to be received the first longitudinally extending channel of the mast, and the latching mechanism is configured to extend through the aperture of the second longitudinally extending channel to thereby allow the pin to be moved at least from the engaged to the disengaged position.

The hub body according to any preceding claim, wherein the umbrella further comprises a canopy configured to drape substantially alongside the mast in at least a retracted form; and a retractable strap contained within the interior region, the strap adapted to pass through the aperture and envelope the canopy in the retracted form to thereby secure the canopy.

An umbrella comprising:

an upstanding mast comprising an interior region and wherein the interior region comprises a longitudinally extending channel with an aperture extending from the interior to the exterior of the mast;

a canopy configured to drape substantially alongside the mast in at least a retracted form; and a retractable strap contained within the interior region, the strap adapted to pass through the aperture and envelope the canopy in the retracted form to thereby secure the canopy.

An umbrella as claimed in any other claim, wherein the retractable strap is mounted in a housing, and the housing is adapted to locate within the interior region of the mast.

An umbrella as claimed in any other claim, wherein the housing comprises a spindle upon which the strap is releasably wound; and a clock spring adapted to bias the spindle into a strap-wound position.

The invention claimed is:

1. A cantilever umbrella comprising an upstanding mast and a cantilever arm adapted to support a canopy, the cantilever arm pivotally attached to the mast at an upper portion and configured to pivot between an open position where the canopy is deployed and where the cantilever arm extends away from the mast, and a closed position where the canopy is withdrawn and the cantilever arm extends close to the mast;

the mast comprising an interior region defined by a longitudinally extending channel with a longitudinally aligned opening extending from the interior to the exterior of the mast wherein the interior channel of the mast comprises an outer facing interior surface and an inner facing interior surface;

a carriage configured to travel longitudinally within the channel, wherein the carriage is moveably supported in the channel by a plurality of wheels, each wheel having two or more wheel surfaces, and wherein the carriage comprises a wheel surface adapted to engage with the outer facing interior surface and a wheel surface adapted to engage with the inner facing interior surface; and a support arm pivotally connected with the cantilever arm at one end, and pivotally connect with the carriage, through the channel opening at an opposing end;

wherein raising of the carriage within the channel causes the cantilever to transition to the open position, and lowering of the carriage causes the cantilever to transition to the closed position.

2. A cantilever umbrella as claimed in claim 1, wherein the outer facing interior surface comprises a longitudinally extending guide surface, and the first set of wheel surfaces comprises a complementary guide surface to the guide surface of the outer facing interior surface such that, in use, engagement of each guide surface provides at least some longitudinal alignment of the carriage within the channel.

3. A cantilever umbrella as claimed in claim 1, wherein the carriage comprises a chassis adapted to support at least one axle; the at least one axle configured to rotationally support the first set of wheel surfaces.

4. A cantilever umbrella as claimed in claim 1, wherein the chassis comprises at least one opening through which the second set of wheel surfaces extends to thereby engage with the inner facing interior surface.

5. A cantilever umbrella as claimed in claim 4, wherein at least the first set of wheels and/or the second set of wheel surfaces are located at an upper end of the carriage and/or the lower end of the carriage, and/or proximate the middle of the carriage.

6. A cantilever umbrella as claimed in claim 1, wherein the carriage further comprises a mount, the mount adapted for the pivotal connection with the support arm; and wherein the mount, pivotal connection or support arm extend from the carriage within the mast interior, through the channel aperture, to the exterior of the mast.

7. A cantilever umbrella as claimed in claim 1, wherein the carriage further comprises an engagement mechanism configured to lock the carriage to the mast, the engagement mechanism comprising:

a locking component operable to transition between an engaged position and a disengaged position; and a biasing component operable to bias the locking component toward the locked position.

8. A cantilever umbrella as claimed in claim 7, wherein the engagement mechanism further comprises a trigger component connected to the locking component and operable to transition from the engaged position to the disengaged position.

9. A cantilever umbrella as claimed in claim 7, wherein the engagement mechanism further comprises a trigger component operably connected to the locking component and configured to at least cause transition of the locking component from the engaged to the disengaged position.

10. A cantilever umbrella as claimed in claim 7, wherein the mast further comprises a receptacle adapted for engagement with the locking component, such that, raising the carriage within the channel causes engagement of the locking component with the receptacle.

11. A cantilever umbrella as claimed in claim 1, wherein the umbrella further comprises a base assembly comprising a base plate and a vertical support member extending from the base plate; the base plate having a plurality of apertures located about the vertical support member, and the vertical support of a form adapted to rotatably receive a second longitudinally extending channel of the mast; and a locking assembly comprising a housing, a latching mechanism, and a pin; the pin supported within the housing and adapted for displacement by the latching mechanism between at least a disengaged position and an engaged position, and orientated within the housing for axial alignment with the plurality of apertures of the base plate; and wherein the housing is of a form adapted to be received the first longitudinally extending channel of the mast, and the latching mechanism is configured to extend through an aperture of the second longitudinally extending channel to thereby allow the pin to be moved at least from the engaged to the disengaged position.

12. A cantilever umbrella as presented in claim 1, wherein the mast comprises at least one receptacle and the carriage comprises an engagement mechanism configured to selectively lock the carriage to the at least one receptacle, the engagement mechanism comprising:

a locking component configured to transition between an engaged position, when aligned with the receptacle, and a disengaged position, and a biasing component operable to bias the locking component into the engaged position when aligned with the at least one receptacle.

13. A cantilever umbrella as claimed in claim 1, wherein the mast comprises at least one receptacle and the carriage comprises an engagement mechanism configured to selectively lock the carriage to the at least one receptacle, the engagement mechanism comprising:

a locking component configured to transition between an engaged position, when substantially aligned with the receptacle, and a disengaged position.

14. A cantilever umbrella as claimed in claim 13, wherein the engagement mechanism further comprises a handle connected to a follower and the locking component comprises a rocker with at least a first lobe arranged to pivot, relative to the carriage, between the engaged position and the disengaged position; and wherein the rocker has a camming surface actuated by the follower so as to cause the at least a first lobe to pivot between the engaged position and the disengaged position.

* * * * *